US011700908B1

(12) United States Patent
Trauner

(10) Patent No.: US 11,700,908 B1
(45) **Date of Patent: *Jul. 18, 2023**

(54) ADHESIVE FOOTWEAR AND DEVICES

(71) Applicant: Kenneth B Trauner, San Francisco, CA (US)

(72) Inventor: Kenneth B Trauner, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/241,372

(22) Filed: Apr. 27, 2021

Related U.S. Application Data

(63) Continuation-in-part of application No. 16/546,110, filed on Aug. 20, 2019, now Pat. No. 10,986,897, which is a continuation-in-part of application No. 15/068,363, filed on Mar. 11, 2016, now Pat. No. 10,383,399, which is a continuation-in-part of application No. 13/886,600, filed on May 3, 2013, now Pat. No. 9,462,849.

(60) Provisional application No. 62/132,503, filed on Mar. 13, 2015, provisional application No. 61/642,059, filed on May 3, 2012.

(51) Int. Cl.

| | |
|---|---|
| ***A43B 13/12*** | (2006.01) |
| ***A43B 3/10*** | (2006.01) |
| ***A43B 7/142*** | (2022.01) |
| *A43B 7/148* | (2022.01) |

(52) U.S. Cl.
CPC ..... *A43B 13/12* (2013.01); *A43B 3/10* (2013.01); *A43B 3/108* (2013.01); *A43B 7/142* (2013.01); *A43B 7/148* (2013.01)

(58) Field of Classification Search
CPC ..... A43B 3/106; A43B 3/108; A43B 3/10; A43B 7/142; A43C 19/00; A61F 5/14; A61F 13/067
See application file for complete search history.

(56) References Cited

U.S. PATENT DOCUMENTS

| | | | | | |
|---|---|---|---|---|---|
| 1,443,844 | A * | 1/1923 | Jensen | A61F 13/066 | 602/66 |
| 1,492,514 | A * | 4/1924 | Jensen | A61F 13/065 | 602/66 |
| 1,512,218 | A * | 10/1924 | Goldsmith | A61F 13/065 | 602/66 |
| 1,615,173 | A * | 1/1927 | Jung, Jr. | A61F 13/065 | 602/66 |
| 1,837,488 | A * | 12/1931 | Romero | A43B 7/22 | 36/180 |
| 1,952,538 | A * | 3/1934 | Devine | A61F 5/14 | 36/164 |
| 2,408,152 | A * | 9/1946 | Porcelli | B60C 27/18 | 152/367 |
| 2,409,594 | A * | 10/1946 | Sherman | A43B 7/141 | 156/196 |

(Continued)

*Primary Examiner* — Ted Kavanaugh
(74) *Attorney, Agent, or Firm* — Staniford Tomita LLP

(57) ABSTRACT

Footwear used for high performance activities such as running can be adhesively attached to the plantar surface of feet rather than uppers or straps. The upper surface of the protective layer of the footwear can have adhesive regions that secure the foot to the footwear and other regions that are not adhesively coupled to the foot. The adhesive regions can be under the heel, along the lateral side of the foot, under the first through fifth metatarsophalangeal (MTP) joints and around the perimeter of the foot above the plantar surface.

16 Claims, 33 Drawing Sheets

(56) References Cited

U.S. PATENT DOCUMENTS

| | | | | | |
|---|---|---|---|---|---|
| 2,985,970 | A * | 5/1961 | McCarthy | A43B 13/00 | 36/106 |
| 3,595,244 | A * | 7/1971 | Kugler | A43B 7/146 | 36/141 |
| 5,146,698 | A * | 9/1992 | Tilles | A43B 7/144 | 36/43 |
| 5,694,704 | A * | 12/1997 | Kasbrick | A43B 3/16 | 36/59 R |
| 5,840,053 | A * | 11/1998 | Roth | A61F 5/0111 | 36/145 |
| 6,120,473 | A * | 9/2000 | Oliverio | A61F 5/14 | 602/41 |
| 6,453,578 | B1 * | 9/2002 | Yung | A43B 7/22 | 36/43 |
| 8,216,162 | B2 * | 7/2012 | Bushby | A61F 5/0127 | 602/61 |
| 9,462,849 | B2 * | 10/2016 | Trauner | A43B 13/32 | |
| 10,383,399 | B1 * | 8/2019 | Trauner | A43B 13/12 | |
| 10,986,897 | B1 * | 4/2021 | Trauner | A43B 13/12 | |
| 2004/0006814 | A1 * | 1/2004 | Holden | A43B 7/1464 | 2/455 |
| 2004/0118020 | A1 * | 6/2004 | Hlavac | A61F 5/14 | 36/140 |
| 2006/0037214 | A1 * | 2/2006 | Goggin-Lewis | A43B 3/106 | 36/11.5 |
| 2006/0265903 | A1 * | 11/2006 | Strong | A43B 7/26 | 36/25 R |

* cited by examiner

FIG. 69
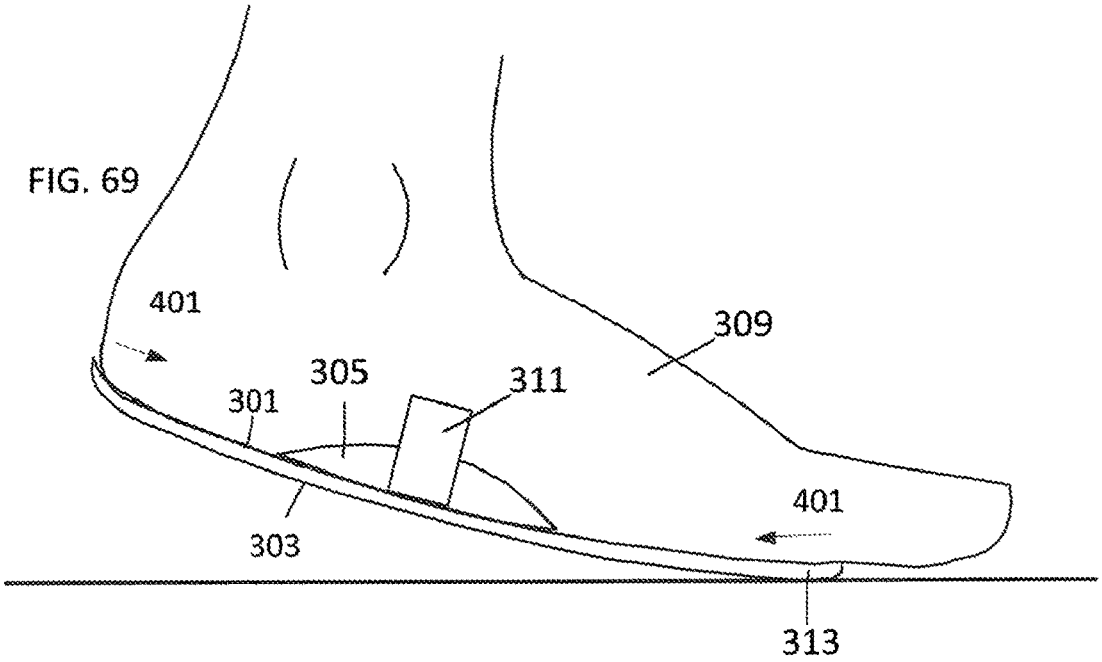
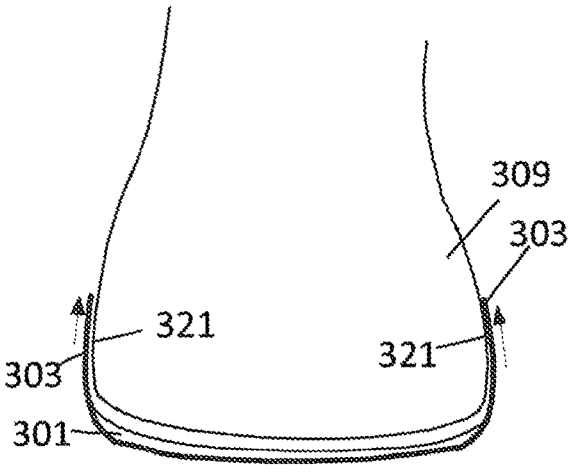
FIG. 70
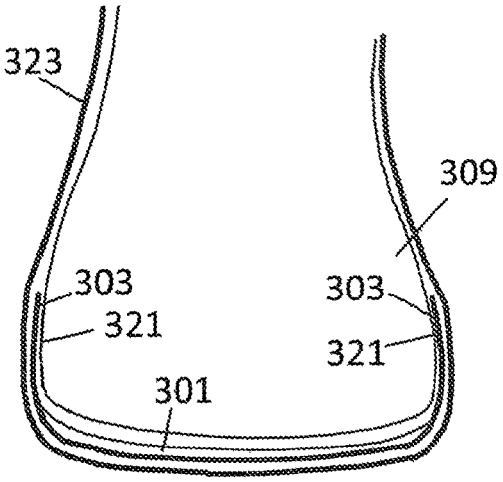
FIG. 71

ADHESIVE FOOTWEAR AND DEVICES

CROSS REFERENCE TO RELATED APPLICATIONS

This application is a continuation-in-part of U.S. patent application Ser. No. 16/546,110, "Adhesive Footwear And Devices" filed Aug. 20, 2019, which is now U.S. Pat. No. 10,986,897, which is continuation-in-part of U.S. patent application Ser. No. 15/068,363, "Adhesive Footwear And Devices" filed Mar. 11, 2016, which is now U.S. Pat. No. 10,383,399 which is a continuation in part of U.S. patent application Ser. No. 13/886,600, "Adhesive Footwear And Devices" filed May 3, 2013 which is now U.S. Pat. No. 9,462,849, which claims priority to U.S. Provisional Patent Application No. 61/642,059, "Adhesive Shoe And Devices", filed May 3, 2012. U.S. patent application Ser. No. 15/068,363 also claims priority to U.S. Provisional Patent Application No. 62/132,503, "Adhesive Multi-Layer Footwear" filed Mar. 13, 2015. U.S. patent application Ser. Nos. 15/068,363, 13/886,600, 61/642,059 and 62/132,503 are all hereby incorporated by reference in their entirety.

BACKGROUND

This invention relates to an adhesive shoe or artificial sole. There are many situations in which a person may wish to walk barefoot but with foot protection. This foot protection can include the benefits of the lower sections of the shoe but without the hindrances of the top of the shoe. No shoes currently exist that perform in a way that mimics the natural performance of the bare human foot. All existing shoes or foot protection devices such as sandals without tops alter gait, are not resilient and have uncomfortable features, and are not functional for higher demand activities.

For example, in warmer climates, sandals are frequently worn with various dorsal mechanical restraints to keep the shoe on the foot. Topless sandals have been available with uniform thickness soles and uniform adhesive applied to the top of the sandal where the upper surface contacts the foot. These sandals are not sufficiently durable at the interface for use in an array of activities and are prone to third body interposition in the interface and discomfort. The limits of existing adhesive designs also require alteration of gait to maintain sandal adherence.

There is a trend towards increased barefoot activity as a way of developing foot strength. These "minimalist" shoes allow the muscles in the foot to gain strength by providing less constriction to the foot. Long-term use of more rigid running shoes is now seen as potentially damaging to the knees. Thus, runners are being encouraged to cross train with shoes that more closely mimic barefoot running. There are also many situations in which improved protection and support is required for the bottom of the foot to protect from injury.

There is a need for footwear applied to the plantar surface of the foot which is functional in a variety of physical environments and suitable for higher demand activities. These higher performance activities include use in water, sand, paved surfaces, etc. The protector needs to support the dynamic structural requirements for a variety of physical exertions including running, jumping, swimming, diving, jogging, etc.

SUMMARY OF THE INVENTION

This invention describes footwear having an artificial sole that is adhesively attached to the foot or an adherent shoe that incorporates various features to more closely facilitate normal gait and to mimic the experience of walking barefoot. This footwear can be used for high performance and high demand activities. In addition, this invention offers the improvements over walking barefoot of offering structure support and protection for the foot throughout gait.

The inventive footwear also incorporates features that allow it to be worn in wet or sandy environment. The inventive footwear can differ from the prior art because it can provide a minimal amount of adhesive contact with the foot that is still sufficient for the high-performance activity that the footwear is being used for. More specifically, the footwear has adhesive regions that are adhesively attached to the foot and non-adhesive regions that are not adhesively attached to the foot.

Previous designs disclose adhesives applied to most or all of the skin on the bottom of the foot which causes discomfort in sensitive portions of the foot. Previous designs also do not provide additional support for the foot biomechanically. The present invention provides a substantial improvement over the prior art. An adherent shoe is disclosed that offers improved biomechanics for a more normal gait that minimizes the amount of adhesive areas required for stability of the shoe. The adhesives are only applied in adhesive zones of the foot and there are other non-adhesive zones of the foot where adhesives are not applied. This combination of adhesive and non-adhesive zones maximizes stability and minimizes discomfort. The present invention also prevents interposition of foreign bodies in the shoe/foot interface and that more closely mimics the barefoot walking experience while providing protection against sharp and hazardous surfaces that may be encountered by the user.

The adhesives can be placed on key locations of the upper surface of the footwear and these adhesive areas can provide at least the minimal adhesion necessary for successful and prolonged adherence during rigorous use. For example, the adhesive regions can include the heel, the lateral side of the foot and a region defined by a border around the first through fifth metatarsophalangeal (MTP) joints. Adhesives can be avoided on the arch region of the foot. Adhesive regions may be placed under the lower contact areas of the toes. However, the areas under the middle sections of the toes should be free of adhesives. In an embodiment, the footwear can include a raised peripheral regions, and an adhesive can be used to couple the inner surface of the raised peripheral regions to the outer side peripheral surfaces of the foot. The peripheral adhesion may include the heel but the adhesive may be excluded from the middle portion, arch, and toes of the feet.

In an embodiment, the adhesive regions can be formed from a thin adhesive material that has a lower surface that is in direct contact with the upper surface of the protective layer and an upper surface that is in direct contact with the foot. The adhesive regions can be formed in recessed areas of the upper surface of the protective layer so that the upper surface of the adhesive regions can be planar and even with the upper surface of the protective layer. Alternatively, the protective layer may not have recessed areas of the upper surface and the adhesive regions can be higher than the upper surface of the protective layer or the upper surface of the adhesive regions can have a ruffled texture that is uneven, which can make the adhesive regions breathable.

The adhesive regions can have shapes that correspond to the heel in the calcaneal area and the lateral side of the foot and the region under the first through fifth MTP joints. If the adhesive regions need to be replaced, the adhesive layers can be removed from the protective layer and replaced. In other embodiments, the adhesive regions can be uniform in shape such as a circle. The user can place the adhesive members in the desired locations on the upper surface of the protective layer avoiding the arch and middle toe areas. In an embodiment, a supply of adhesive members can be supplied to the user. For example, if the adhesive members are circular, the supply can be stored in a cylindrical stack from which individual adhesive members can be removed and used.

In an embodiment, the adherent qualities of the adhesive regions may vary by location. Some adhesive regions can have a strong adhesive bonding on areas where the shear movement should be minimized such as under the heel. However, other adhesive regions can have lower strength adherent qualities. For example, in an embodiment, the raised edges of the footwear may be intended to keep debris away from the foot and may have a lower strength adhesive. Thus, the adhesive regions can be non-uniform in adherence. Various types of adhesives can be suitable for the inventive footwear. For example, the adhesion mechanism can utilize Van der Waal force adhesion, which does not use glues or chemicals that can leave a residue. Other suitable adhesives include surgical skin adhesives that can be in the form of pressure-sensitive adhesive tape that can have a hypoallergenic adhesive. This adhesive tape can be elastic and breathable.

In an embodiment, the protective layer of the footwear can have a non-uniform thickness with a heel cup having additional padding, the arch and mid foot having less padding thicknesses and the toes having even less padding. The variable thickness of the footwear can range from about 5 mm to 20 mm. In an embodiment, the thickness of the protective layer of the can mimic the natural padding of the foot In an embodiment, the some or all of the perimeter of the footwear can have upward raised edges. The raised edges may surround the rear foot and extend forward to the toes. The raised edges may be omitted from the front portion of the footwear adjacent to the toes. The raised edges can improve the stability of the footwear by preventing the foot from sliding over the edges of the footwear. The raised edges also increase the contact area on the border of the foot. The adhesion plane is on near vertical perimeter surfaces of the foot which are at a nearly perpendicular angle to the plantar surface of the foot. In contrast to relying upon a peel adhesion force between the footwear and the foot, the raised edges are configured to provide shear force adhesion and have increased resistance to pull off of the adhesive boundary.

In an embodiment, the inventive footwear can include flexible elastic tabs that can be thin high tensile strength structures that are attached to portions of the perimeter of the footwear or the raised edges of the footwear. The tabs can wrap over the top and/or side portions of the foot to more securely attach the footwear to the perimeters surfaces of the foot and function to securely attach the footwear to the foot like the edge adhesive mechanisms as described above. Like the edge adhesives, the tabs are a vehicle to change the orientation of the peel off forces needed to disengage the adherent foot surface. In an embodiment, the tabs can be replaceable strips of adhesive backed material. If the tab structure or the adhesive fails and needs to be replaced, the entire tab can be removed from the footwear and replaced. In an embodiment, the tab can be attached to the footwear mechanically or with an adhesive that is different than the adhesive used to attach the footwear to the user's foot. The replacement tabs can be inserted into slots along one or more edges of the protective layer of the footwear.

In an embodiment, the inventive footwear can include an arch support that can be integrated into the footwear. In an alternative embodiment, the arch support can be a modular structure that is adhesively attached to the upper surface of the protective layer. The arch support can be an elastic structure that can compress or expand with the movement of the foot. The arch support can include a plurality of fenestrations that can be arranged in a radial pattern across the width of the footwear. In a preferred embodiment, the upper surface of the arch support is not adhesive and does not stick to the arch surface of the foot. The upper surface of the arch support can slide against the bottom arch area of the foot. The arch support without the adhesive can improve the comfort of the inventive footwear. The upper surface of the arch support is a non-adhesive region of the footwear and the adhesive regions of the footwear do not contact the arch support area of the user's foot.

In other embodiments, this invention relates to a multi-layered sole that is adhesively attached at adhesive regions to the person's feet. The adhesive material can surround the outer perimeter of the multi-layer sole and can be used to attach the sole to the user's feet. The arch support can be a separate elastic structure that can have a specific size and shape that is based upon the anatomy of the user's feet. More specifically, the user can select a specific shoe sole size and then select a specific arch support having a size that will properly fit the arch of the user's foot. While two users may select the same shoe sole size, a flat-footed user may need a lower arch support while another user may need a thicker arch support. The arch support can be adhesively attached to the sole of the foot and precisely positioned against the arch portion of the foot for better contact between the foot and arch support. However, the lower surface of the arch support may not be attached to the upper surface of the sole portion of the footwear. Because the sole can be adhesively attached to the foot and move with the foot rather than the sole portion of the shoe footwear, there is movement between the sole portion of the shoe footwear and arch support minimal movement between the arch of the foot and arch support component of the footwear.

There are many situations in which a person may wish to walk barefoot but with an arch support and some foot protection for the sole of the foot. This foot protection can include the benefits of the lower sections of the shoe but without the hindrances of the top of the shoe. In an embodiment, the inventive multi-layered adhesive sole can be worn alone and in other embodiments, the multi-layered sole can be worn within a sock that is then placed in a shoe, boot, or other footwear.

The adhesive material can be wet or dry adhesives. On one embodiment the adhesive is a hydrogel. Hydrogels can have a flexibility that mimics that of natural tissues including the sole of the foot and can be absorbent absorb the skin evaporative losses. Hydrogels can be composed of cross-linked polymers such as polyethylene oxide, polyAMPS, and polyvinylpyrrolidone commonly used to attach electrodes to skin for prolonged periods. The crosslinking within the hydrogel can provide the adhesive bonding between the footwear and the skin of the user's foot.

As perspiration occurs through the surface of the foot, this invention describes the use of porous materials along the plantar surface of the foot. These porous regions can occur selectively along the plantar surface of the foot. The porous zones can occur in either adhesive or non-adhesive zones. As porosity in the adhesive zone in some strategies can reduce the adhesive strength, this invention describes the use of porosity in the shoe surfaces specifically in the non-adherent regions of the shoe. In one embodiment, this can include porosity in the arch of the foot.

BRIEF DESCRIPTION OF DRAWINGS

FIGS. 66-69 illustrate side views of a foot and adhesive footwear components.

FIG. 70 illustrates a rear view of a foot and adhesive footwear components.

FIG. 71 illustrates a rear view of a foot and adhesive footwear components under a sock.

DETAILED DESCRIPTION OF INVENTION

Figure 1:
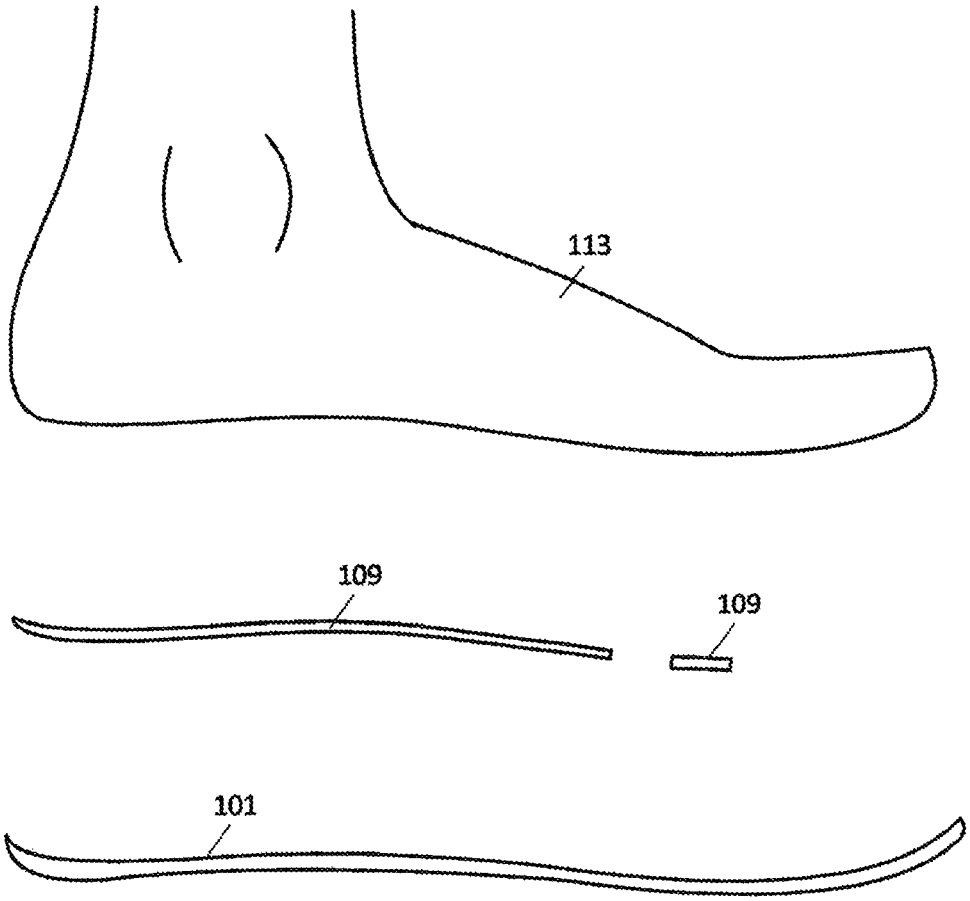
FIG. 1 illustrates an exploded side view of an embodiment of the inventive footwear.
Figure 2:
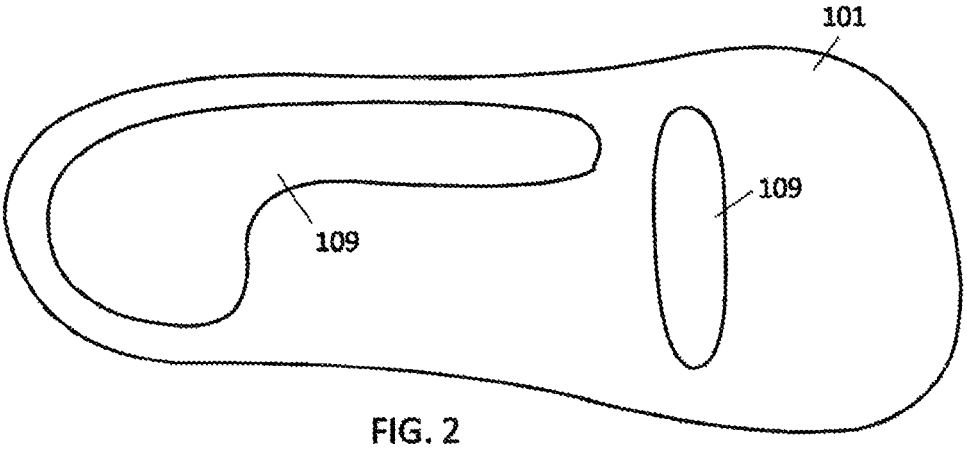
FIG. 2 illustrates a top view of an embodiment of the inventive footwear having different peripheral features.

With reference to FIG. 1, an exploded view of the components of the present invention is illustrated. The illustrated footwear can include a protective layer 101 and a plurality of adhesive regions 109 that are used to attach the protective layer 101 to a plantar surface 111 of a foot 113. The inventive footwear is designed for high performance activities including: running, hiking, beach activities, water sports such as swimming, surfing, paddling, etc. The footwear has a sole or protective layer 101 that has an upper surface 103 that can conform to the plantar surface 111 of the foot 113. With reference to FIG. 2, a top view of an embodiment of the inventive footwear is illustrated with the plurality of adhesive regions 109 placed on specific areas of the upper surface 103 of the protective layer. In this embodiment, the adhesive regions 109 are placed on portions of the upper surface 103 that correspond to the ball region of the foot from the first metatarsal head to the fifth metatarsal head and a rear region of the foot that includes the heel and a lateral side of the foot. The adhesive regions 109 do not include areas of the upper surface 103 that correspond to the arch of the foot or in this embodiment the toes.

A protective layer having an upper surface that is completely covered with an adhesive to attach the footwear to the foot can be problematic. Experimentation has demonstrated that adhesives used on specific zones of the foot interfere with certain motions and generate shear at the skin that can cause foot discomfort and blistering. Specific examples of problem areas include adhesive in the region of the arch of the foot and on the undersurface of the toes. The area under the arch is sensitive to shear forces and similarly, the toes may require freedom of movement while walking and running. By removing the adhesives from these areas and designating them as non-adhesive regions, the comfort and performance of the footwear is greatly enhanced.

The present invention describes a plurality of configurations that can each be used to provide maximum stability while minimizing the size of the adherent regions on the shoe. Minimizing the extent of the adherence has been shown to markedly improve the comfort to the wearer. As discussed above, those areas constitute the area on the ball of the foot, the heel of the foot and in a zone along the lateral side of the plantar foot. In an embodiment, the plurality of adhesive regions can cover less than 40% of the upper surface of the protective layer and the non-adhesive regions of the footwear can cover over 60% of the upper surface of the protective layer.

Figure 3:
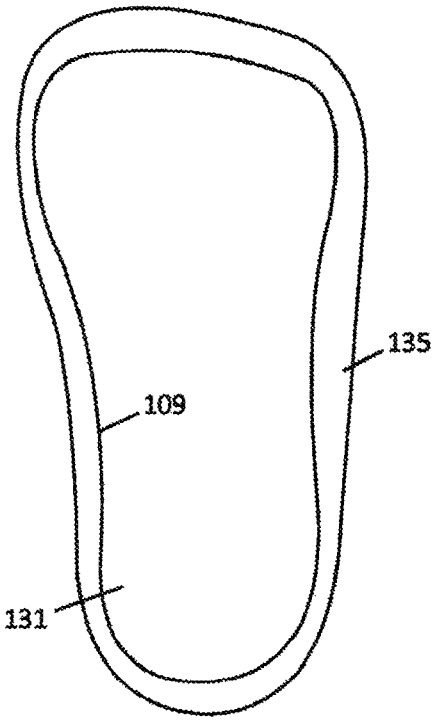
FIGS. 3-6 illustrate top views of different embodiments of the inventive footwear.
Figure 4:
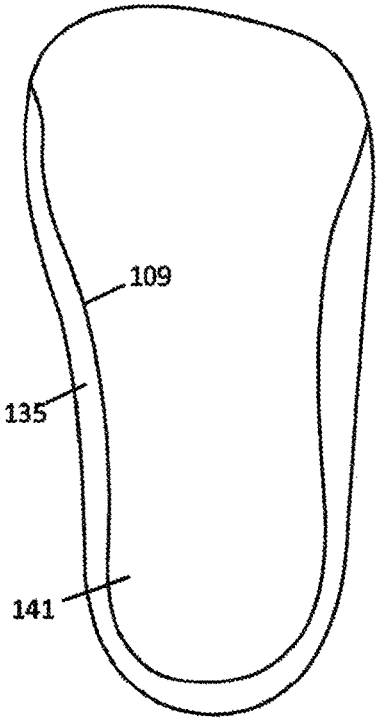

For higher demand activities, the protective layer can extend upwards around portions of the perimeter of the foot. With reference to FIGS. 3-6, embodiments of the inventive footwear are illustrated. For simplicity, the adhesive regions 109 on the upper surfaces of the protective layers are not illustrated. With reference to FIG. 3, an embodiment of the protective layer 131 is illustrated with a perimeter upward extending member 135 that extends around the entire perimeter of the foot. The inner surfaces of the perimeter upward extending member 135 can have adhesive regions 109 that are used to attach the protective layer 131 to the sides of the feet above the plantar surface. With reference to FIG. 4, an embodiment of the protective layer 141 is illustrated with a perimeter upward extending member 135 extending around the rear foot portion of the foot and the sides of the forefoot. The perimeter upward extending member 135 does not extend across the front of the toes. The perimeter upward extending members can provide additional stabilizing surfaces along the posterior aspect of the heel for increase stability for high demand activities.

Figure 5:
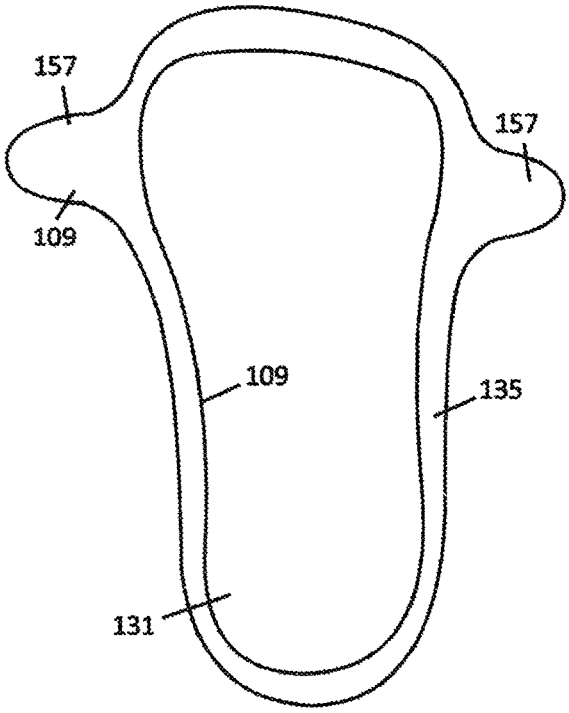
Figure 6:
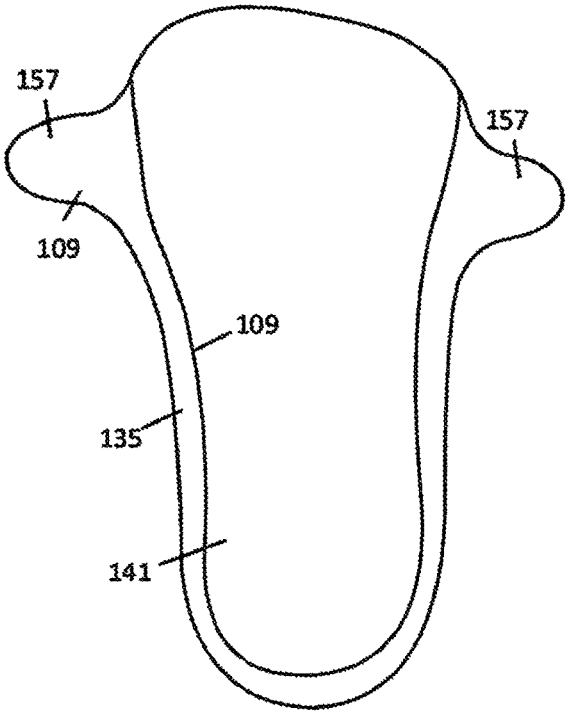

With reference to FIGS. 5 and 6, in an embodiment, the footwear can include tabs 157 that extend to the lateral border of the fifth metatarsophalangeal (MTP) joint and the first MTP joint. The tabs 157 can wrap around and the inner surfaces of the tabs 157 can include adhesive surfaces 109. The tabs 157 can be adhesively secured to the sides of the foot to further increase the stability of the footwear on the user's foot.

Figure 7:
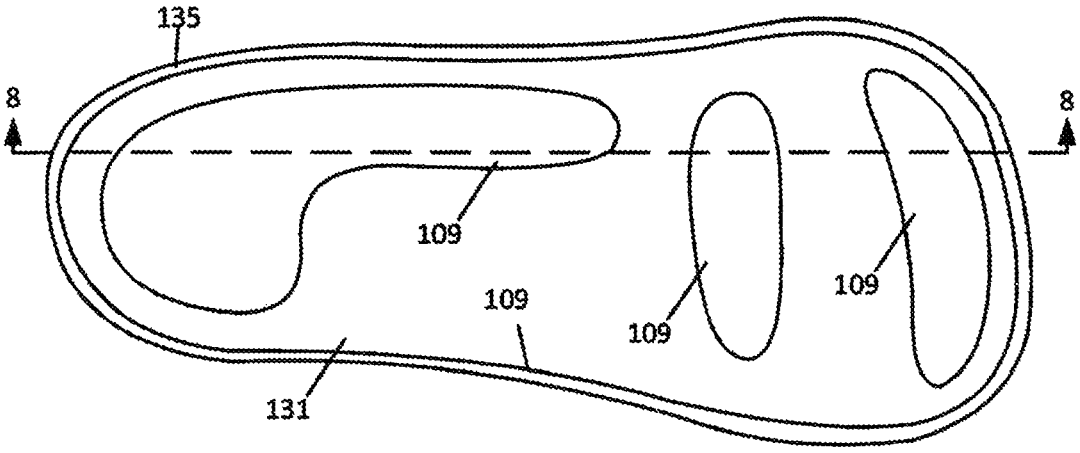
FIG. 7 illustrates a top view of an embodiment of the inventive footwear.
Figure 8:
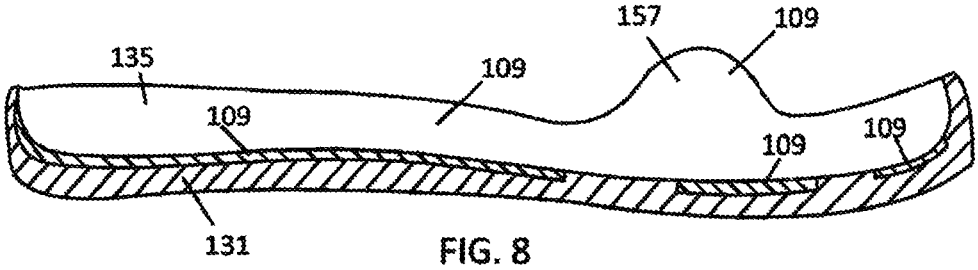
FIG. 8 illustrates a cross sectional side view of an embodiment of the inventive footwear.
Figure 9:
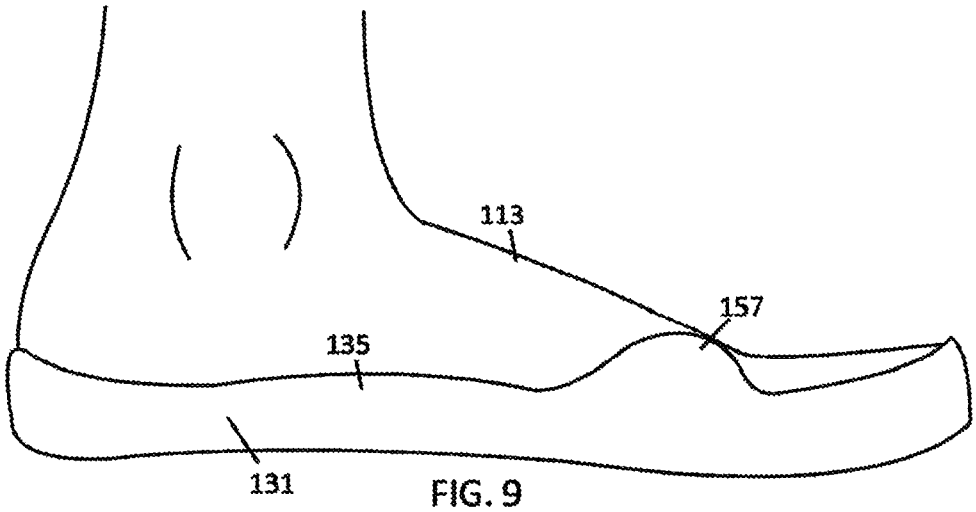
FIG. 9 illustrates a side view of a foot wearing an embodiment of the inventive footwear.

With reference to FIGS. 7-9, in another embodiment, the perimeter upward extending member 135 can extend around the entire perimeter of the protective layer 131. FIG. 7 illustrates a top view of the protective layer 131. In this embodiment, one of the adhesive regions 109 includes the heal and lateral side of the foot, a second adhesive region 109 includes the region under the MTP joints of the foot and a third adhesive region 109 includes an area where the bottoms of the toes contact the upper surface of the protective layer 131. FIG. 8 illustrates a cross section view of the protective layer 131. The adhesive regions 109 can be placed within recessed spaces 108 in the upper surface of the protective layer 131 so that the upper surfaces of the adhesive regions 109 and the upper surface of the protective layer 131 are flush and substantially at the same height. The perimeter upward extending member 135 can have adhesive regions 109 on the inner surfaces facing the foot that can secure the footwear to the foot 113 above the plantar surface. FIG. 9 is a side view of a foot 113 wearing the inventive footwear. This configuration may be preferred for hiking or walking in areas in which loose bodies can enter the interface between the footwear and the foot 113. The added protection around the front of the foot 113 can prevent particles from falling between the foot 113 and the protective layer 131.

Figure 10:
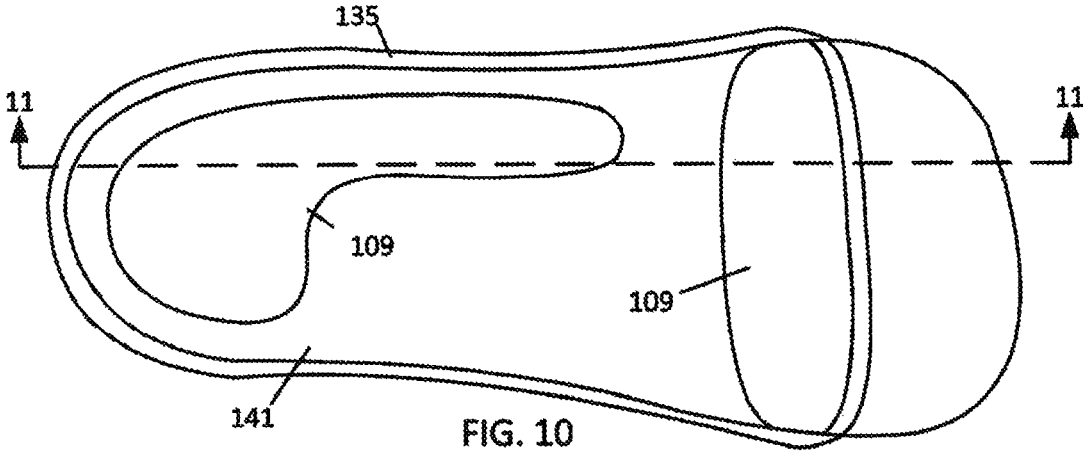
FIG. 10 illustrates a top view of an embodiment of the inventive footwear.
Figure 11:
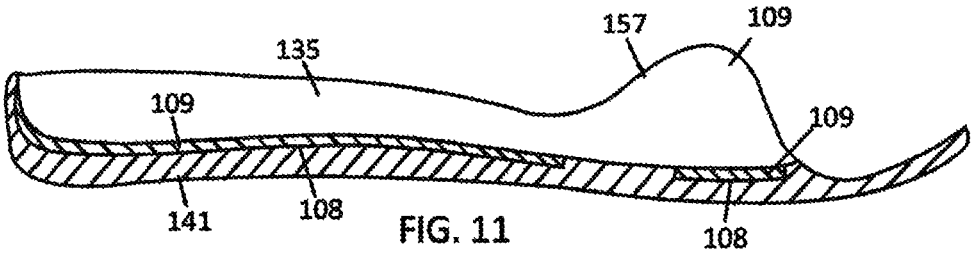
FIG. 11 illustrates a cross sectional side view of an embodiment of the inventive footwear.
Figure 12:
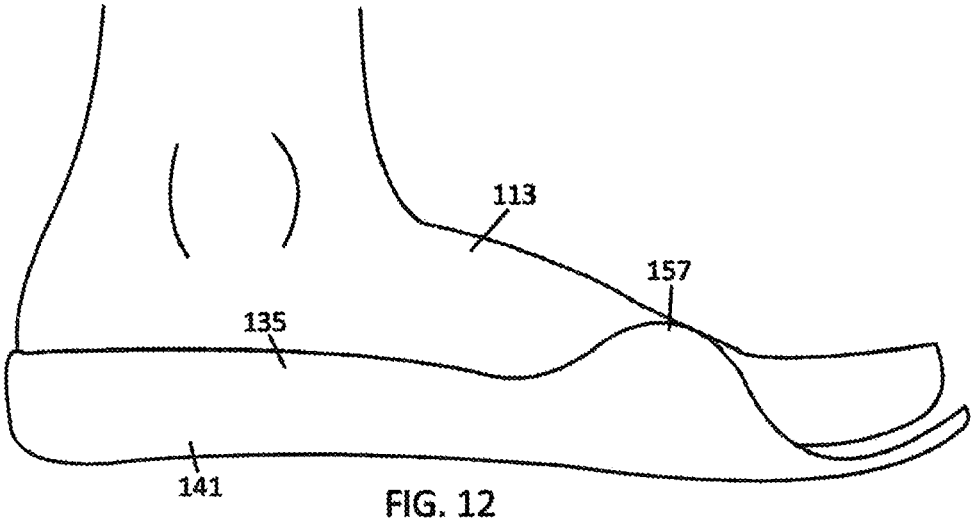
FIG. 12 illustrates a side view of a foot wearing an embodiment of the inventive footwear.

With reference to FIGS. 10-12, in an embodiment, the inventive footwear with the perimeter upward extending members 135 can be used in wet or sandy environments. FIG. 10 illustrates a top view of the protective layer 141 with adhesive regions 109 on the heel area and the lateral side and the region under the first through fifth MTP joints. FIG. 11 illustrates a cross sectional view of the protective layer. In the illustrated embodiment, the protective layer 141 has recessed spaces and the adhesive regions 109 can be inlayed within the recessed spaces 108. FIG. 12 illustrates a side view of a foot 113 in the inventive footwear. The perimeter upward extending member 135 can have adhesive regions 109 on the inner surfaces that can border the foot circumferentially except for the forefoot end. Tabs 157 can be attached to the perimeter upward extending member 135 adjacent to the first and fifth MTP joints. Other adhesive regions 109 can cover the heel and a lateral side of the foot and extend across the width of the protective layer 141 beneath the region of the MTP joints. The adhesive region 109 can end just distal to the "ball of the foot." The upper surface of the protective layer forward of the MTP joins can be free of adhesive regions 109. This can allow free motion of the toes without encumbrance. The toes can be freely positioned above the front of the protective layer while the remainder of the plantar surface of the foot can be protected from exposure to fluid or sand particles by the adhesive regions 109. This configuration allows users to get their toes wet and sandy but provides both adherence and seals the rest of the foot from exposure.

Figure 13:
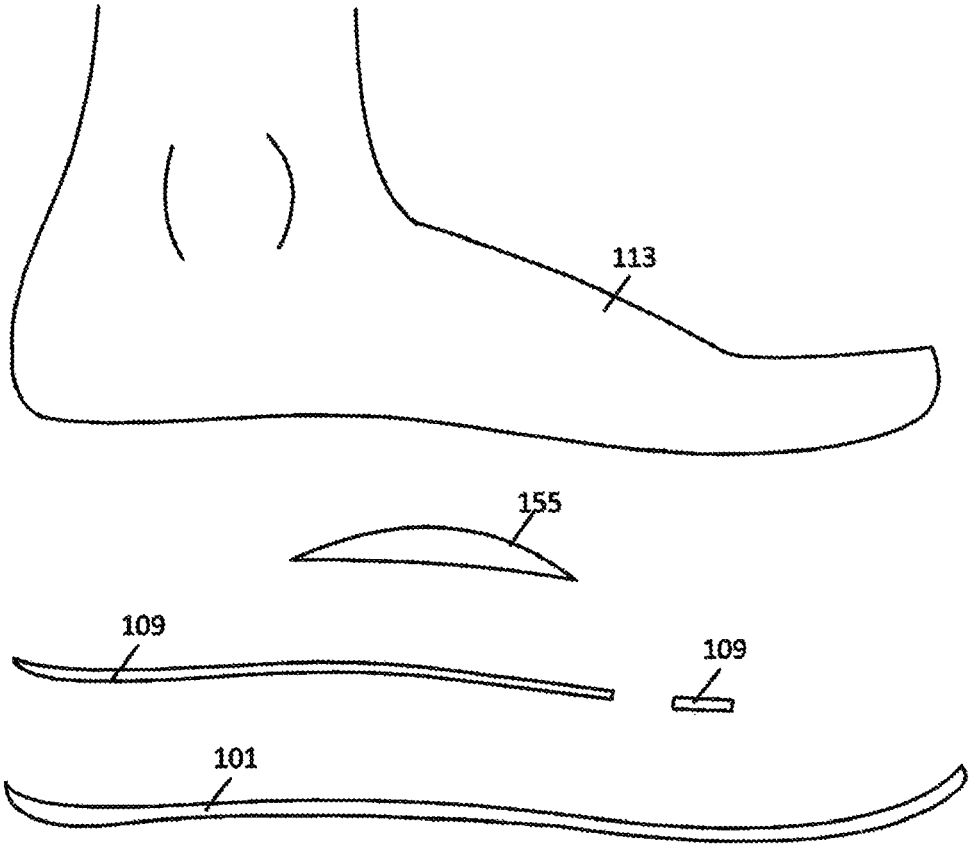
FIG. 13 illustrates an exploded side view of an embodiment of the inventive footwear.
Figure 14:
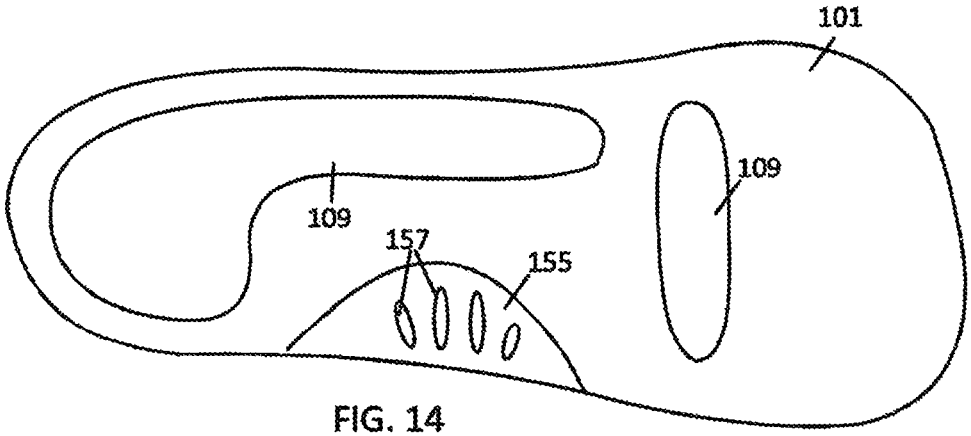
FIG. 14 illustrates a top view of an embodiment of the inventive footwear.

In an embodiment, the arch can have a convex upper exposed surface that is built into the upper surface of the protective layer. However, in other embodiments, the arch can be a modular structure that can be selected to properly fit the arch of the user and secured to the upper surface of the protective layer. With reference to FIG. 13, an exploded side view of a protective layer 101, adhesive regions 109, a modular arch 155 and a foot 113 are illustrated. The arch 155 and the adhesive regions 109 can be adhesively bonded to the protective layer 103. FIG. 14 illustrates a top view of the upper surface 103 of the protective layer 101 with the adhesive regions 109 and the modular arch 155 attached to the upper surface of the protective layer 103.

The arch of the foot can go through a dynamic transformation during gait and running. At heel strike, the arch 155 can be stretched longitudinally and then the arch can progressively collapse through gait in the longitudinal plan. The arch 155 can be made of an elastic material and may include a plurality of fenestrations 157 that allow the arch 155 to stretch and compress more easily. The fenestrations may be arranged in a radial pattern extending outward from the lateral side of the arch. In an embodiment, the inventive footwear can apply dynamic structures such that an arch 155 of the shoe that allows for expansion at heel strike and collapse through other portions of gait to minimize any shear forces that may be transmitted by the footwear to the skin surface on the arch of the foot.

Figure 15:
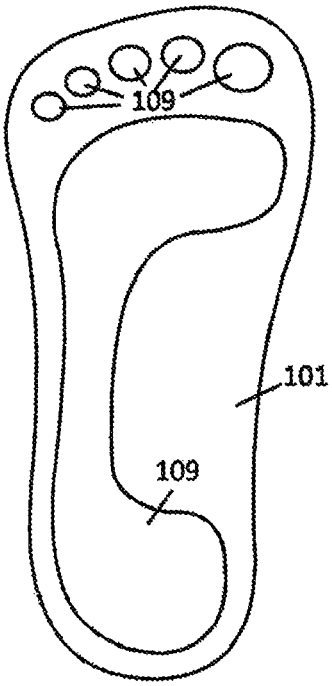
FIGS. 15-18 illustrate top views of different embodiments of the inventive footwear having different adhesive region configurations.
Figure 16:
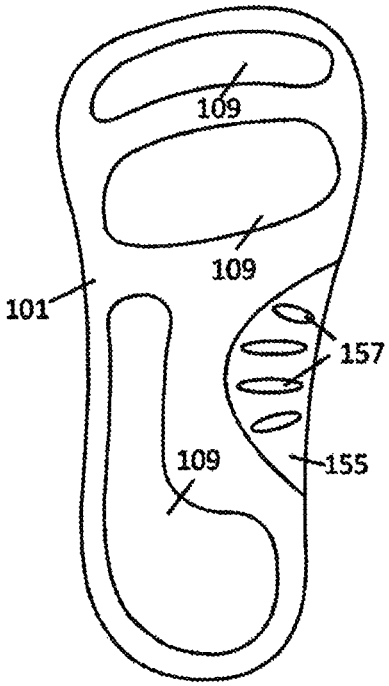
Figure 17:
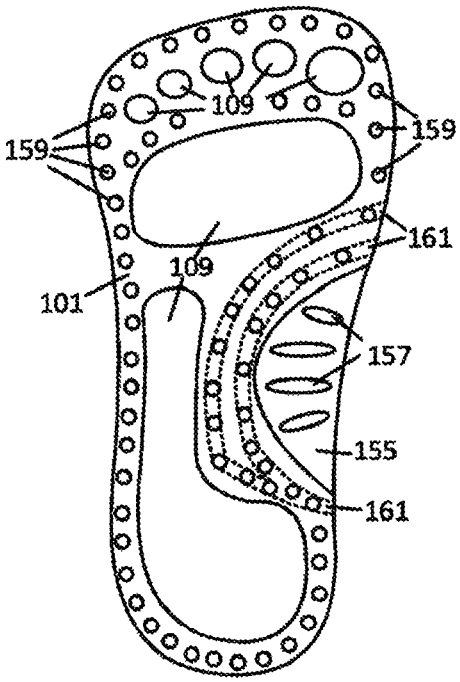
Figure 18:
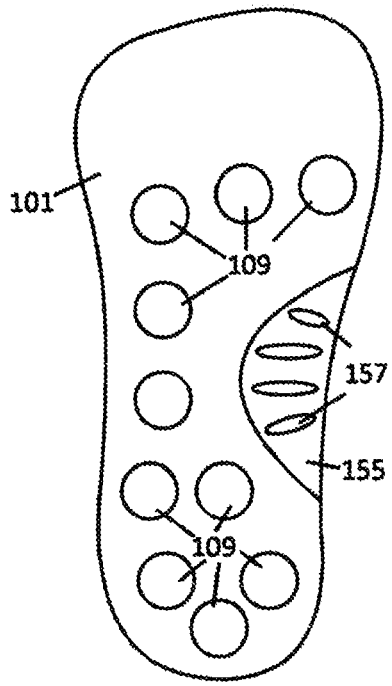

In different embodiments, the inventive footwear can include various combinations of features. With reference to FIGS. 15-18, different embodiments of the upper surface of the inventive footwear are illustrated. With reference to FIG. 15, the adhesive regions 109 include individual toe contact points that can each be substantially circular in shape and a single adhesive region 109 that includes the heel, the lateral side of the foot and the area under the MTP joints on the upper surface of the protective layer 101. With reference to FIG. 16 the adhesive regions 109 include a single region that extends under the toe contact points, a region under the MTP joints and a region under the heel and lateral side of the foot. An arch support 155 having fenestrations 157 can be coupled to the upper surface of the protective layer 101. With reference to FIG. 17, in an embodiment, the upper surface the protective layer 101 can include ventilation holes 159 that extend partially or completely through the protective layer 101. This embodiment of the present invention can include channels 161 that extend through the thickness of the protective layer 101 in a path that can be parallel to the upper surface of the protective layer 101. These holes and fluid flow paths through the protective layer 101 can allow the footwear to have improved breathability and water drainage.

Although the adhesive regions have been illustrated as having shapes that correspond to specific anatomical features that can fit into recesses in the upper surface of the protective layer, in other embodiments, the adhesive regions 109 can be uniform in shape. For example, with reference to FIG. 18, the adhesive regions 109 are circular in shape. In this embodiment, the adhesive regions can be placed on the protective layer 101 in positions selected by the user to provide the desired adhesion to the foot. In an embodiment, the adhesive regions 109 can be modular adhesive pads. As the adhesive regions 109 wear or lose their adherent properties, the modular adhesive regions 109 can be replaced. The adhesive regions 109 can be double-sided adherent pads that may be elastic and compressible to conform to the surface of the foot and be replaced to preserve the longevity of the footwear. In other embodiments, the adhesive regions 109 can be thin double-sided adherent pads that may not be significantly elastic or compressible.

Figure 19:
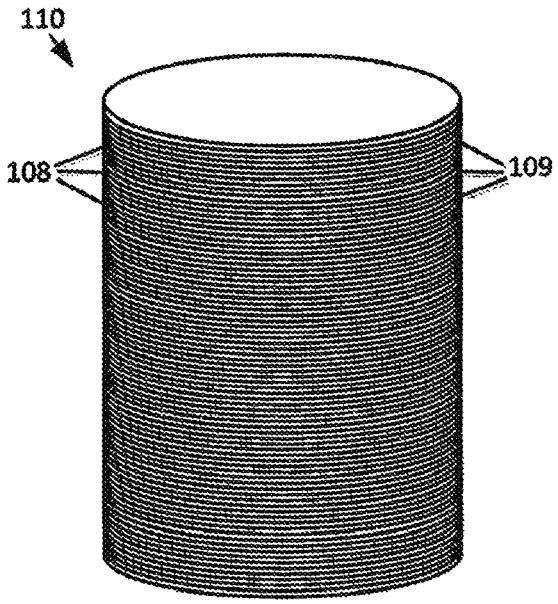
FIG. 19 illustrates a stacked structure of adhesive regions.

With reference to FIG. 19, the adhesive regions 109 can be stored in a stacked configuration 110 which can be a cylindrical or other elongated structure. The user can remove the individual adhesive regions 109 and placed them on the protective layer 101 as they are needed. In an embodiment, the individual adhesive regions 109 can be separated by release layers 108 of wax paper or silicone release coated paper which prevents the adhesive regions 109 from sticking to each other. Although the adhesive regions 109 are illustrated in FIG. 19 are illustrated as being circular in shape, in other embodiments, the adhesive regions 109 can be any other suitable uniform shape including: ovals, polygons, etc. This invention describes the use of modular pads. As the adherent regions 109 wear or lose their adherent properties, the adherent regions 109 can be removed and replaced. This invention describes the use of double sided adherent pads that can be replaced to preserve the longevity of the overall shoe.

Figure 20:
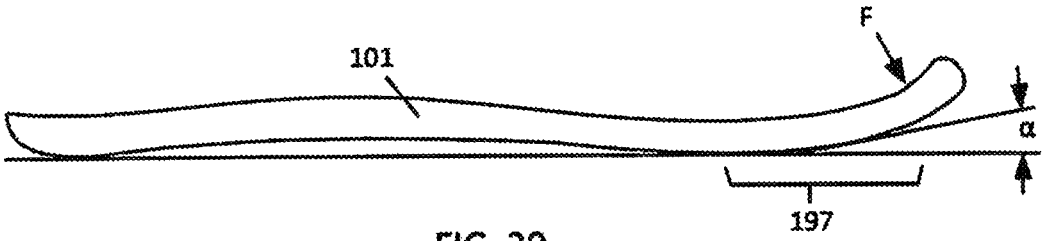
FIGS. 20-21 illustrate side views of an embodiment of the protective layer.
Figure 21:
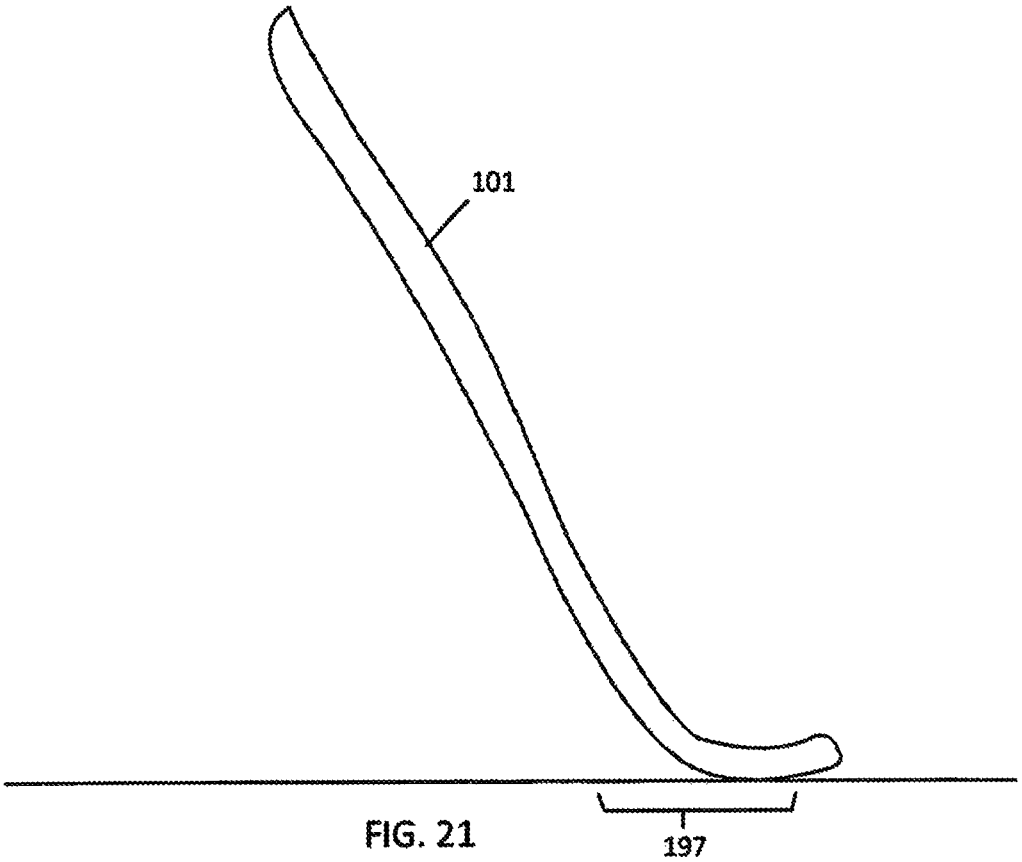

The angle and conformation of the footwear is also critical in order to prevent biomechanical difficulties during the various phases of user's gait. Specifically, flat adherent footwear can cause problems for the user during the "toe off" phase of gait and can lead to altered gait patterns. For example, a steppage gait has been observed in users with flat adherent design footwear. In an embodiment with reference to FIGS. 20 and 21, the inventive footwear can include an asymmetric dorsiflexion mechanism 197 built into the protective layer 101 that extends from the level of MPT joints to the distal portion of the footwear in the region of the toes. The dorsiflexion can be asymmetrically flexible to allow the forefoot toe portion of the protective layer 101 to bend upwards from a normal angle $\alpha$ between the forefoot and the rear foot sections as shown in FIG. 21. From the upward bent position, the toes can exert downward force and the foot can then leave the ground. During the next step, the forefoot can be returned to its normal position, shown in FIG. 20. In a preferred embodiment, the forefoot region cannot bend downward from the original angle $\alpha$ relative to the rear foot region. In an embodiment, the original angle $\alpha$ is greater than or equal to 10 degrees. This inflexibility can keep the toes up and prevent the front of the footwear from accidentally rolling under the lower surface of the protective layer which can leave the toes exposed. However, in other embodiments, the flexibility acts as a spring and allows the toes to overpower the upward spring force of the dorsiflexed toe plate so that the angle becomes less than a. This flexibility can function to support more dynamic activities such as running.

Figure 22:
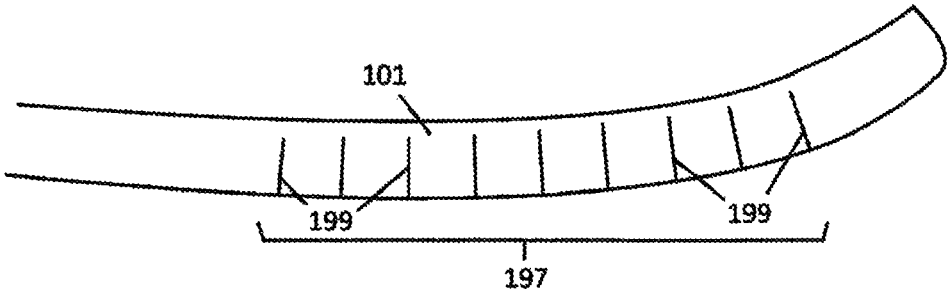
FIGS. 22-23 illustrate side view of an embodiment of an asymmetric dorsiflexion mechanism.
Figure 23:
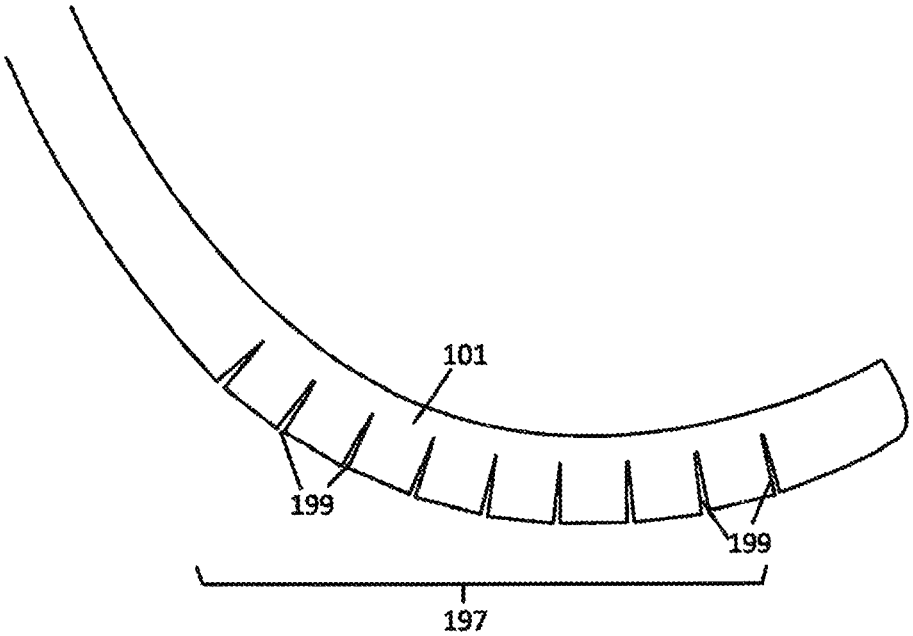

With reference to FIGS. 22 and 23, an embodiment of an asymmetric dorsiflexion mechanism 197 is illustrated. FIG. 22 illustrates the protective layer 101 from the level of MPT joints to the distal portion. The asymmetric dorsiflexion mechanism 197 can include a plurality of thin grooves or cuts 199 that extend partially through the thickness of the protective layer 101 and run across the width of the protective layer 101. When the user presses down on the toe portion of the protective layer 101, the thin grooves or cuts 199 cannot compress and resist the movement of the toes. However, when the toe portion of the protective layer 101 rotates upward, the grooves or cuts 199 are able to open and the asymmetric dorsiflexion mechanism 197 can allow the protective layer 101 to bend.

Figure 24:
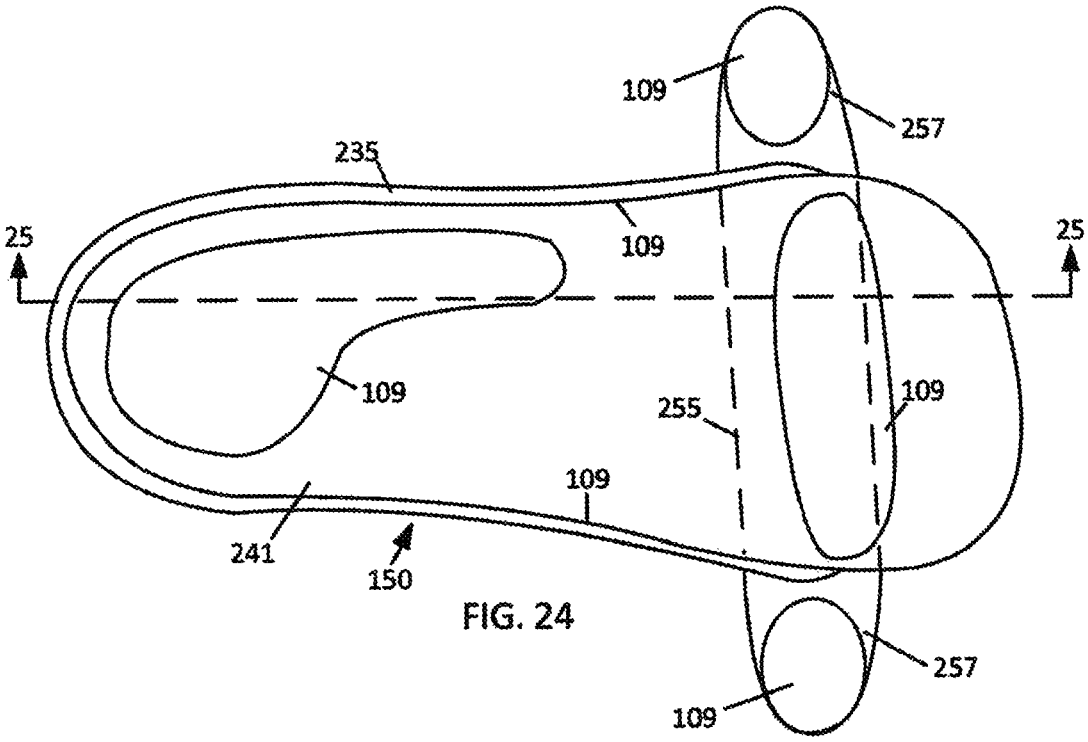
FIG. 24 illustrates a top view of an embodiment of the inventive footwear with replaceable tabs.
Figure 25:
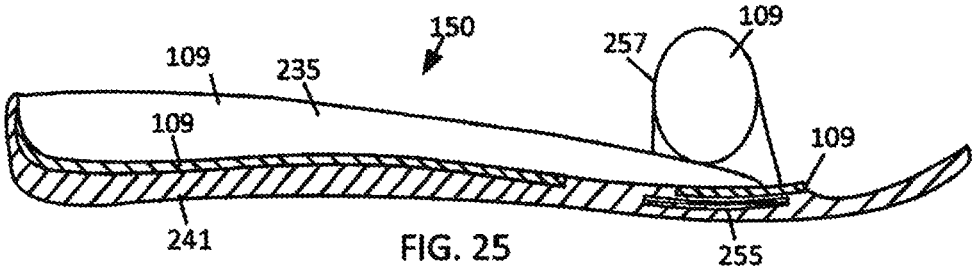
FIG. 25 illustrates a cross section side view of an embodiment of the inventive footwear with replaceable tabs.

As discussed, the tab structure can be a replaceable structure that can be used to secure the footwear to the foot. With reference to FIGS. 24 and 25, the tab 257 can be a replaceable structure having adhesive regions 109 that can be wrapped over and can be secured to the sides and top of the foot. FIG. 24 shows a top view of an embodiment of the inventive footwear 150 having a protective layer 241, a raised edge 235 and adhesive regions 109. In this embodiment, the tab 257 can be made of a single flexible high tensile strength material that passes through a hole or slot 255 that runs through the width of the protective layer 241.

FIG. 25 shows a cross sectional side view of the footwear 190. In the illustrated embodiment, the center portion of the tab 257 can be placed through the hole or slot 255 and held is the desired position with an adhesive or mechanical fastener. If the tab 257 breaks or wears out, it can be removed from the hole or slot 255 and a new tab 257 can be placed through the hole or slot 255 to replace the worn or broken tab 257.

Although the tab 257 is shown as a single piece structure, in other embodiments, the footwear can have two separate tab structures. One tab can extend out of each of the exits of the hole or slot 255. One end of the tab can be placed in the hole or slot 255 and the other end can extend from the side of the protective layer and wrapped over the foot. When one tab needs to be replaced, the individual tab can be removed from the hole or slot 255 and replaced while the remaining tab can remain attached to the protective layer.

Figure 26:
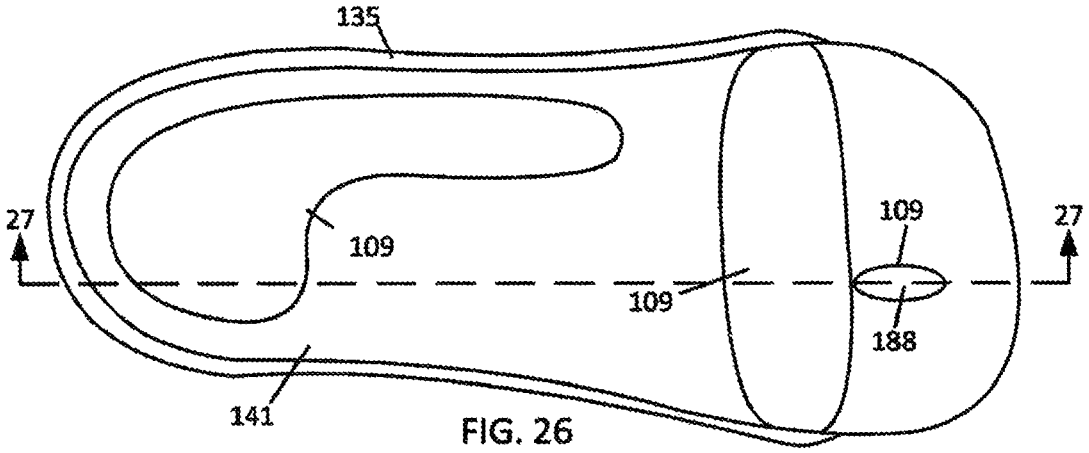
FIG. 26 illustrates a top view of an embodiment of the inventive footwear having a toe tab.
Figure 27:
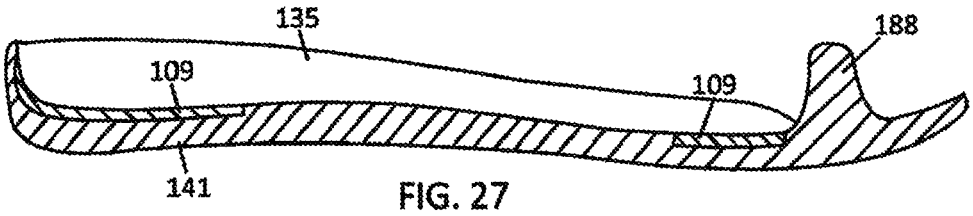
FIG. 27 illustrates a side cross section view of an embodiment of the inventive footwear having a toe tab.
Figure 28:
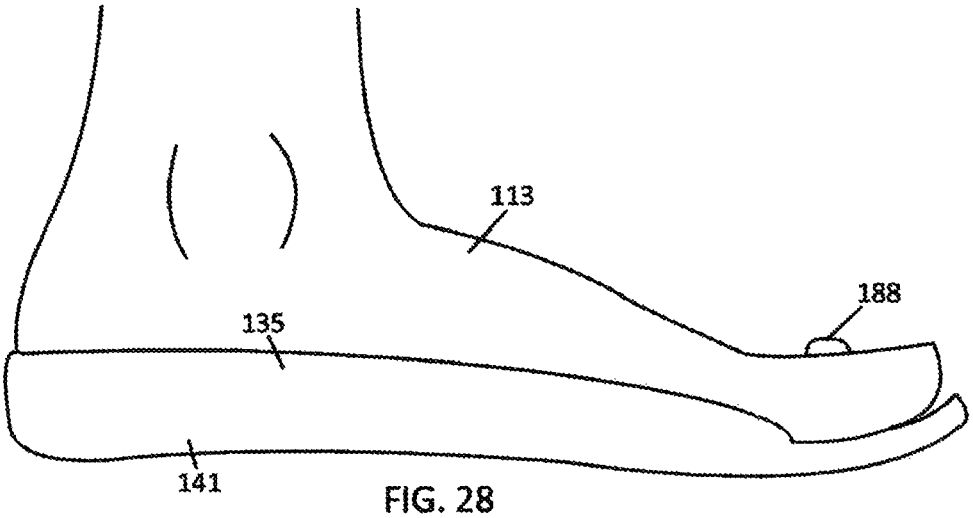
FIG. 28 illustrates a side view of a foot wearing an embodiment of the inventive footwear having a toe tab.

With reference to FIGS. 26-28, in another embodiment, the inventive footwear can have a toe tab 188 can be rigidly attached to the upper surface of the protective layer 141. The toe tab 188 can extend upward from the protective layer 141 between the big toe and the second toe. The outer surfaces of the toe tab 188 can be covered with an adhesive region 109 so that the toe tab 188 is coupled to the webbing of the inner surfaces between the big toe and the second toe. FIG. 26 illustrates a top view of the protective layer 141 with the toe tab 188 having an elongated oval cross section. FIG. 27 illustrates a cross section of the footwear. In an embodiment, the toe tab 188 can be integrated with the protective layer 141. However, in other embodiments, the toe tab 188 can be modular and replaceable. FIG. 28 illustrates a side view of a foot 113 wearing the footwear with the top of the toe tab 188 extending above the tops of the toes.

Figure 29:
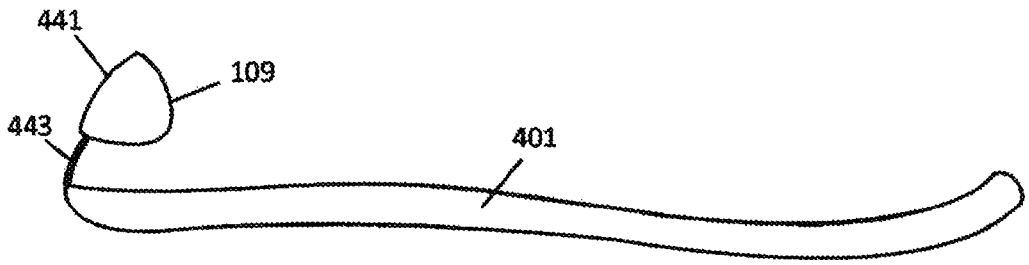
FIG. 29 illustrates a side view of an embodiment of the inventive footwear having a heel tab.
Figure 30:
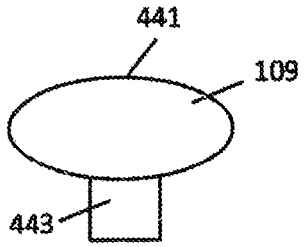
FIGS. 30 and 31 illustrate views of an embodiment of the heel tab.
Figure 31:
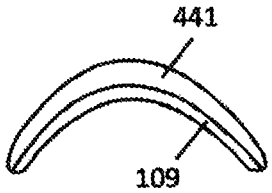
Figure 32:
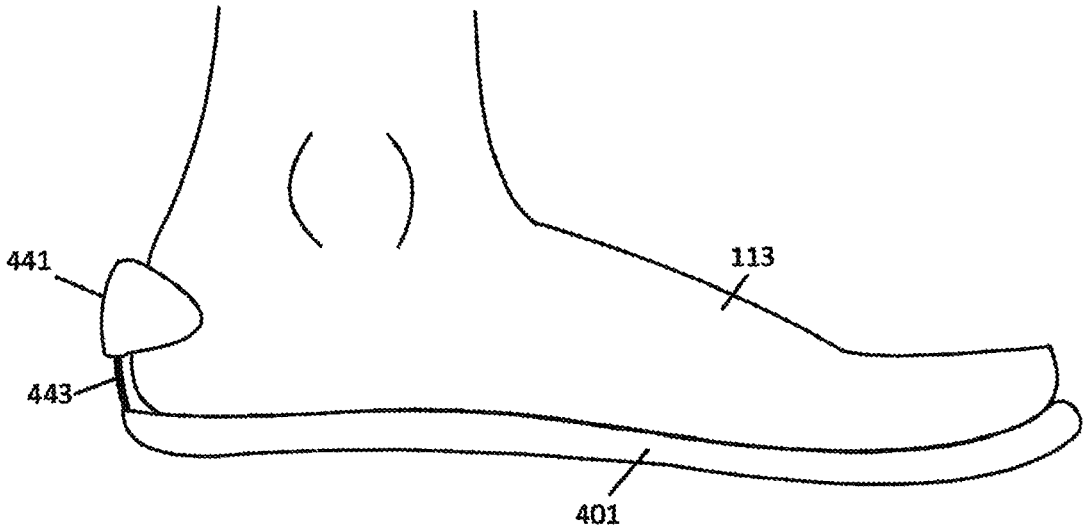
FIGS. 32 and 33 illustrate side views of embodiment of a user's foot wearing the inventive footwear having a heel tab.
Figure 33:
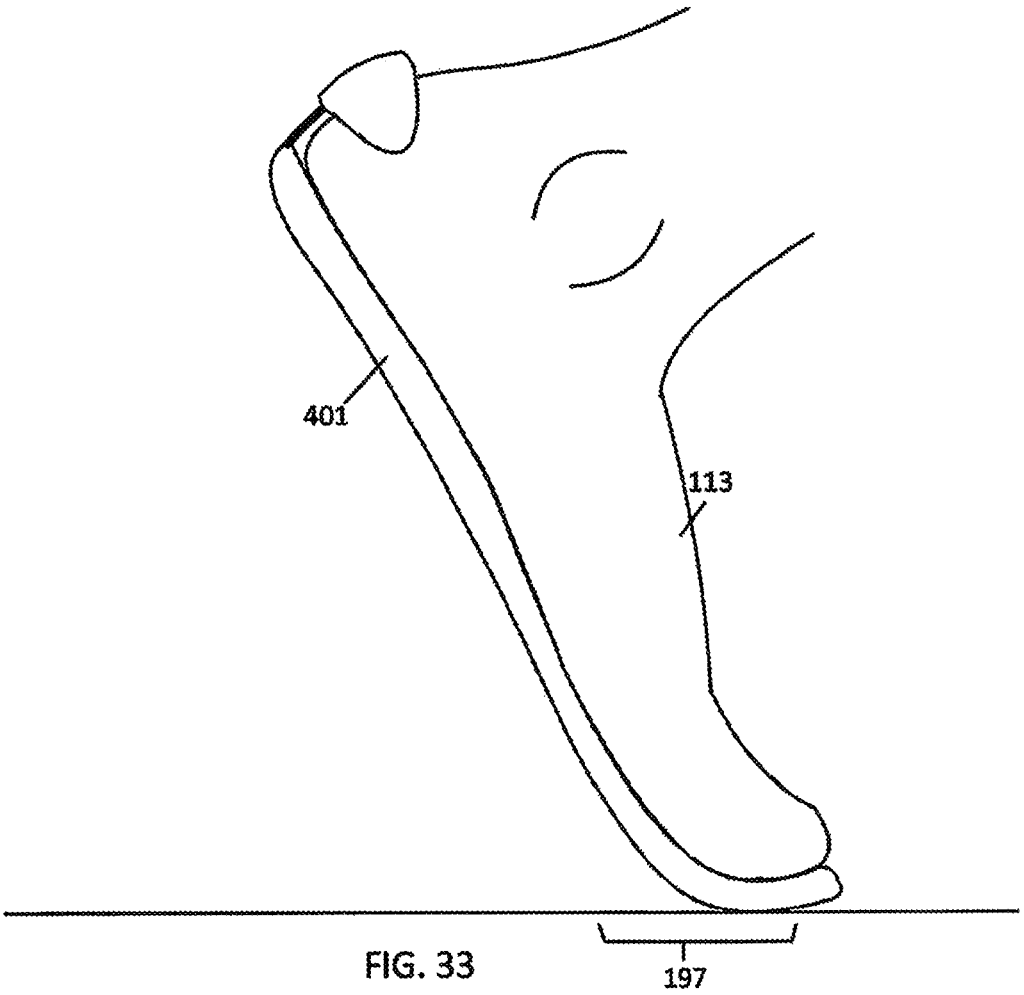

The inventive footwear has been described as relying upon adhesive regions on the protective layer to secure the footwear to the foot. However, with reference to FIGS. 29-33, a heel tab mechanism can be used to improve the adhesion of the heel portion of the footwear to the foot. FIG. 29 illustrates a side view of a protective layer 401 having a heel tab 441 coupled to the heel portion with a spring mechanism 443. FIG. 30 illustrates a heel facing view of the heel tab 441 having an adhesive region 109 on the inner surface. FIG. 31 illustrates a top view of the heel tab 441 showing the curvature and the adhesive region 109 on the inner surface. The heel tab 441 can have rounded edges and surfaces. FIG. 32 shows a foot 113 on the protective layer 401 with the heel tab 441 attached to the heel of the foot 113. The spring mechanism 443 can compress the heel tab 441 against the heel of the foot 113. The protective layer 401 can have the same adhesive regions 109 on the upper surface as shown in FIGS. 1 and 2. These adhesive regions 109 can be very good at preventing horizontal movement of the foot 113 relative to the protective layer 401. However, it can be more difficult to hold the protective layer 401 against the foot 113 as the heel rises. The bending of the protective layer 401 can generate a force that can tend to pull the protective layer 401 away from the heel of the foot 113. Thus, the connection of the heel tab 441 to the heel of the foot 113 can prevent this separation. With reference to FIG. 33, a side view of the foot 113 with a raised heel is illustrated. The heel tab 441 helps to hold the heel of the protective layer against the foot 113. In other embodiments, the illustrated heel tab 441 can be used with other types of footwear including sandals and flip-flops.

Figure 34:
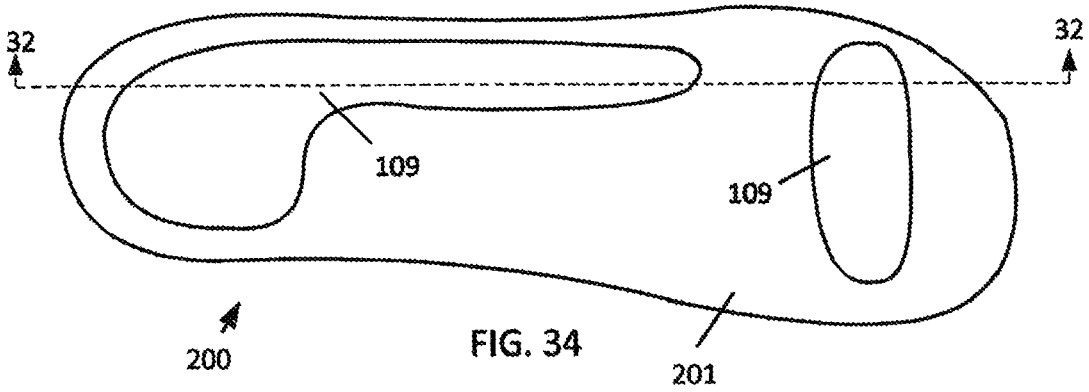
FIG. 34 illustrates a top view of a high heel embodiment of the inventive footwear.
Figure 35:
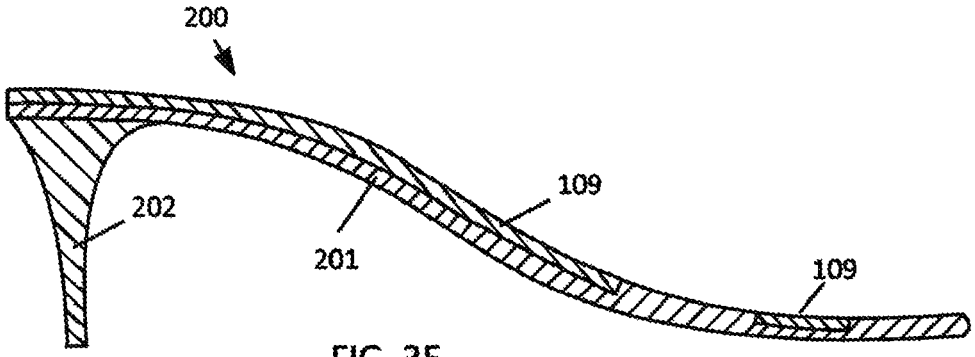
FIG. 35 illustrates a cross sectional side view of a high heel embodiment of the inventive footwear.
Figure 36:
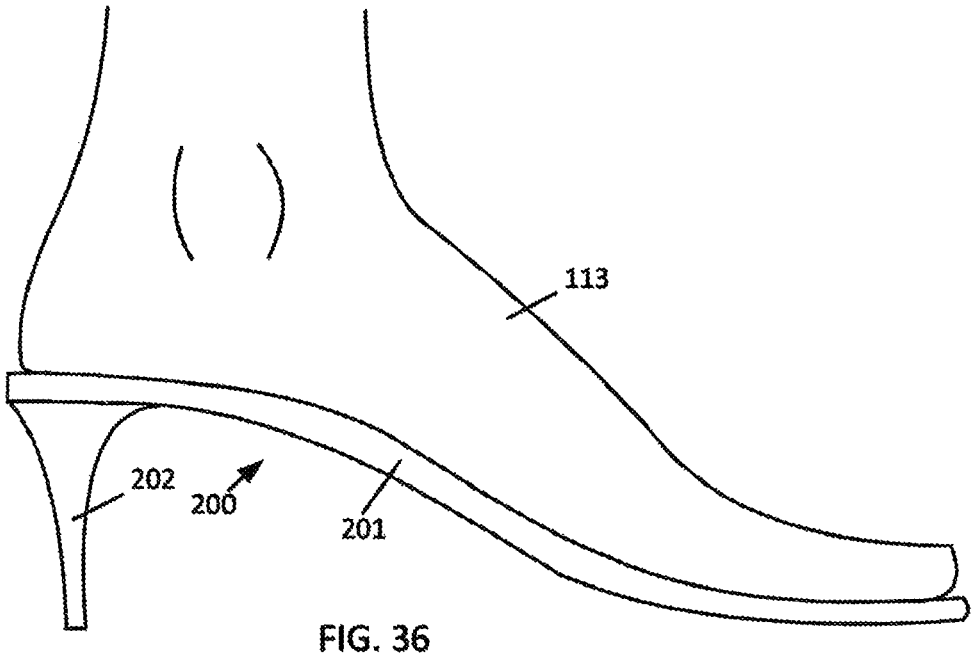
FIG. 36 illustrates a side view of a high heel embodiment of the inventive footwear on a foot.

The inventive footwear has been described as being used with flat high performance unfashionable applications. However, in other embodiments, the inventive adhesive regions 109 can be used with more aesthetically pleasing high heel footwear 200 as shown in FIGS. 34-36. FIG. 34 illustrates a top view of the high heel footwear 200 with the protective layer 201 and the adhesive regions 109 on the upper surface of the protective layer 201. FIG. 35 illustrates a cross sectional side view of the footwear 200. The adhesive regions 109 can be placed in recessed spaces in the upper surface of the protective layer 201. The heel 202 can raise the rear portion of the footwear 200. The protective layer 201 can be made of a more rigid high strength material which can support the weight of the user between the heel 202 and the forefoot section of the footwear 200. FIG. 36 illustrates a side view of the footwear 200 being worn on a foot 113. Because of the adhesive regions 109, straps are not required to hold the footwear 200 to the foot 113. However, in other embodiments, ornamental straps can be used with the footwear 200.

The present invention utilizes adhesive regions to attach the footwear to the foot. Various different adhesives can be used with the inventive footwear. In an embodiment, a "gecko" adherence technology can be used which does not require the use of traditional tack adhesives. The adherent zone can comprise microstructures that have extensive surface area due to the size and number of microscopic hair like structures. The surface area generates Van der Waal forces sufficient for two surfaces to adhere to each other.

There are numerous advantages to Van der Waal adherent technology. If a "tack adhesive" is not used, there is no residue which can be left on either of the bonding surfaces. The bonding performance is maintained indefinitely. In contrast, the bonding performance of tack adhesives can degrade readily or only be appropriate for limited on off cycles. Tack adhesives can also require the use of chemicals and require a separate layer of material for holding the tack adhesive.

However, many tack adhesives are specifically designed for bonding to human skin. In particular, many adhesives are specifically designed for medical applications and are specifically formulated to avoid skin irritation and allergic reactions. An example of a suitable tack adhesives that can be used in the adhesive regions of the inventive footwear is 3M Medical Specialties Product Number 1504XL, Hi Tack Medical Transfer Adhesive on Extended Liner. This adhesive is a synthetic rubber and resin system that can be applied to opposite sides of a thin plastic film and cut to the required shapes of the adhesive regions. The bonding properties of this adhesive can be measured by attaching the adhesive to stainless steel and measuring the force required to remove the adhesive with a 90 degree peel. The nominal force required to remove the adhesive is 5.7 kg/25.4 mm width of adhesive.

Figure 37:
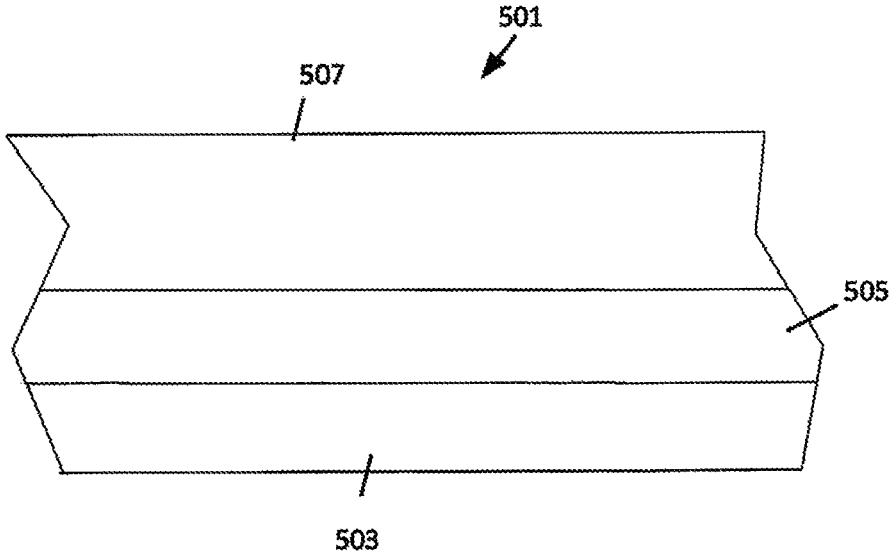
FIG. 37 illustrates a side view of an embodiment of a two sided tape that can be used for the adhesive regions.

In another embodiment, 3M Medical Specialties Product Number 1577, Two-in-One Polyester Double Coated Tape can be used for the adhesive regions. A side view of this tape 501 is illustrated in FIG. 37. The tape 501 can use two types of adhesives coated on opposite sides of a carrier polyester film 505. A synthetic rubber adhesive 503 can be used to secure the adhesive region to the upper surface of the protective layer and the inner surfaces of the raised edges or tabs. An acrylic adhesive 507 can be used to secure the adhesive region to the skin of the user of the footwear. In this embodiment, the two adhesives can have different bonding properties. The synthetic rubber adhesive 503 can require a nominal force of 2.8 kg/25.4 mm width of adhesive and the acrylic adhesive 507 can require a nominal force of 1.5 kg/25.4 mm width of adhesive. This configuration can cause the synthetic rubber adhesive regions to be more aggressively bonded to the protective layer than the foot so that the adhesive regions will remain in place on the footwear when the foot is removed. The synthetic rubber adhesive 503 may also be thinner than the acrylic adhesive 507. Because the upper surface of the protective layer can be smooth, the contact area between the protective layer and the synthetic rubber adhesive 503 can be very high since the adhesive 503 does not need to conform to an uneven topography. In contrast, the acrylic adhesive 507 may need to elastically conform to the skin surface which can be an uneven surface. A thicker layer of acrylic adhesive 507 can allow a better interface between the skin and the adhesive 507. In other embodiments, any other suitable materials can be used for the adhesive regions.

The protective layers described above, can be many of various rigid or elastic materials. The bottom surface of the protective layer preferably has a non-skid tread which provides traction on the surfaces that the footwear is being used. The protective layer should be able to protect the foot from sharp objects and may also provide some cushioning for the foot to reduce the impact while performing activities such as running on pavements. As discussed, the thickness of the protective layer can be variable with a thicker section at the heel and a thinner more flexible construction at the forefoot portion. The protective layer can be made of multiple materials. For example, the bottom surface can be a strong wear resistant rubber material layer that provides the tread for the footwear. A layer of foam or other elastic material can be attached over the rubber material to provide cushioning for the foot. The upper surface of the protective layer can be made of a smooth material that is comfortable against the plantar surface of the foot.

The upper surface of the protective layer may have a shape that conforms to the contours of the planar surface of the user's foot. The topography of the upper surface of the protective layer may be a custom product based upon actual surface measurements of the user's foot or may correspond to a generic shape based upon the size of the user's foot. The lower surface can have a flatter profile across the width to provide better stability and a larger contact area for improved traction.

Although footwear has been described, the present invention can also be used for other functionality. For swimming, webbing extensions using the described adhesive regions increase the forces that can be applied to the feet for swimming apparatus such as adherent flippers for swimming, scuba and snorkeling. Adherent flippers can include adherent sections applied to the dorsum of the foot or forefoot to avoid separation from the foot during the upstroke portion of the swimming motion. The inventive adhesive regions can eliminates the need for a heel strap on the flippers and allows for a more conforming forefoot design.

The inventive adhesive regions on a protective layer of footwear can also be applied to other types of shoes. In an embodiment, the footwear can include abrasion resistant coverings for protecting the toes which can be part of specialty shoes used for activities such as ballet and rock climbing. In other embodiments, the protective layer of the inventive footwear can be very stiff in order to transmit more leg energy for activities such as skiing, crew and cycling. This special footwear can be equipped with specific types of cleats which can be locked into corresponding sport specific binding mechanisms. For some footwear spikes or other protruding mechanisms can be attached to the bottom of the protective layer.

Figure 38:
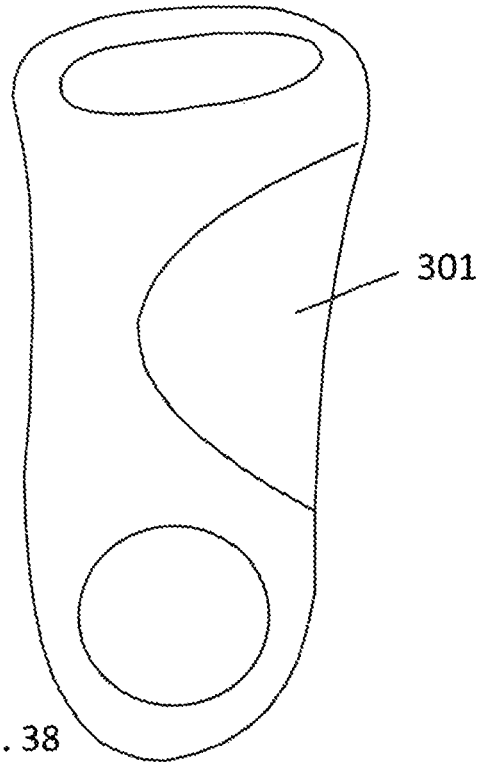
FIG. 38 illustrates a top view of an embodiment of an elastic layer.
Figure 40:
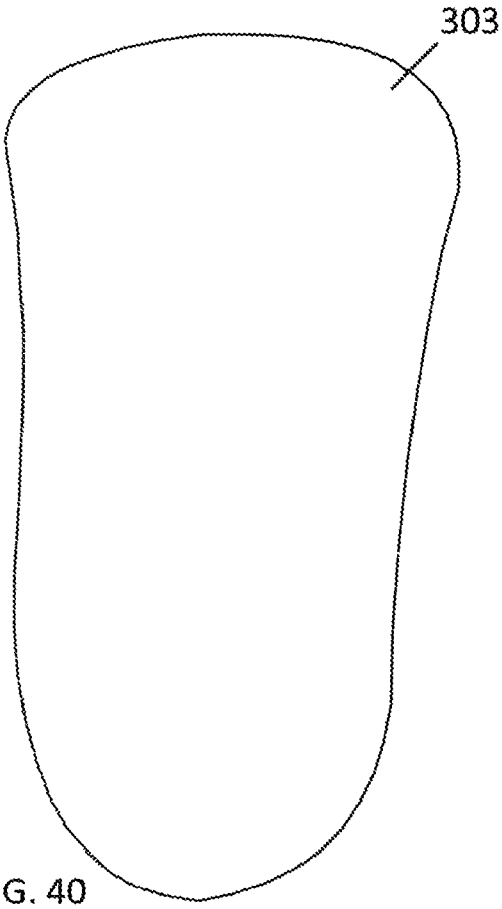
FIG. 40 illustrates a top view of an embodiment of a protective layer.

With reference to FIG. 38, an embodiment of multi-layered adhesive footwear can include an elastic layer 301 attached to a protective layer 303 shown in FIG. 40. The elastic layer 301 can be an elastic fabric layer that is made from a template that can correspond or match the perimeter of the user's foot and includes markings that indicate the heel, arch, ball, and base of the toes. The elastic layer may extend to the first through fifth MTP joints of the foot but not over the toes. In some embodiments, elastic layer templates can be available in multiple standard show sizes and widths like normal shoes. In other embodiments, the templates can be custom designed to match the feet of individual users and stored in a digital form so that the elastic layers 38 can be cut from the elastic material when the adhesive footwear is ordered from a manufacturer.

In an embodiment, the elastic layer can have a contoured upper surface that includes a heel cup and arch support that extend up above the plane of the protective layer to support the heel and arch of the foot. In other embodiments, the elastic layer may only have a heel cup but not have an integrated arch support structure. In some of these embodiments, the arch support area of the elastic layer can be flat and the arch support can be provided by a separate arch support structure.

With reference to FIG. 38 the elastic fabric that has been marked with lines showing the perimeter of the template and the position of the arch support. The elastic layer has been cut to the shape of the full template and the arch support in the designated area of the elastic fabric.

The upper surface of the protective layer 303 can be partially or completely covered with an adhesive. In some embodiments, the protective layer 303 can include a thin adhesive layer and a wax paper or other protective layer can protect the adhesive material from contamination before use. When the wax paper is peeled away, the adhesive is exposed, and the protective layer 303 can be bonded to the elastic layer 301.

Figure 39:
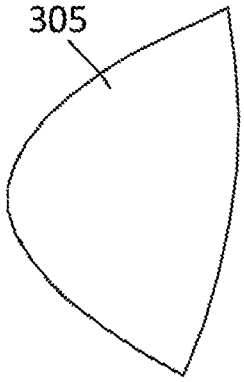
FIG. 39 illustrates a top view of an embodiment of an arch support.

FIG. 39 illustrates an arch support structure 305 which can be a separate structure from the elastic layer 301 and the protective layer 303. The arch support structure 305 can be made of an elastic material, which can provide comfortable cushioning for the arch portion of the foot. In other embodiments, the arch support structure can be integrated into the elastic layer 301.

Figure 41:
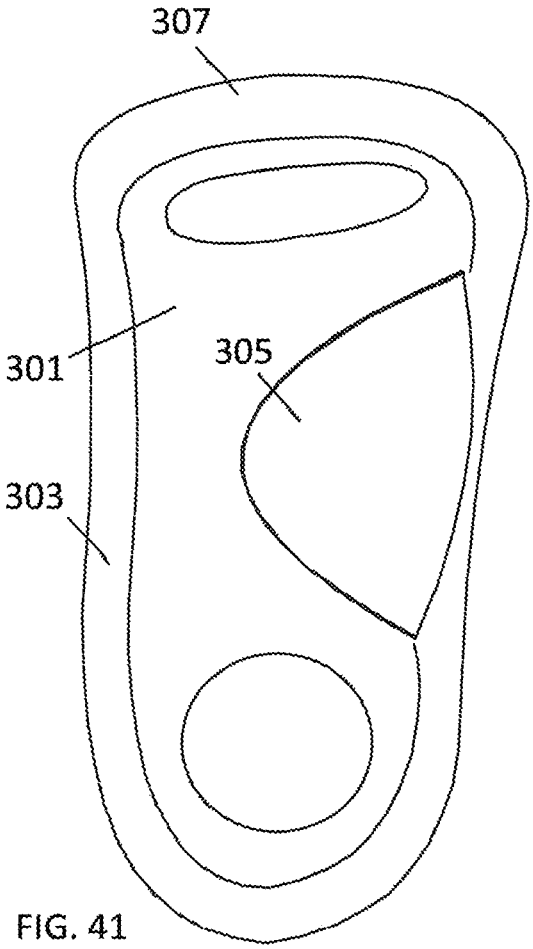
FIG. 41 illustrates a top view of an embodiment of the assembled adhesive footwear.

With reference to FIG. 41, an embodiment of an assembled multi-layered footwear is illustrated. The adhesive on the upper surface of the protective layer 303 can be exposed, and the elastic layer 301 can be bonded to the protective layer 303. In an embodiment, the arch support structure 305 can be attached to the adhesive material on the protective layer 303 and positioned under the arch support area of the elastic layer 301. In other embodiments, the arch support 305 may be placed over the upper surface of the elastic layer 301. In these embodiments, the arch support structure may not be physically attached to the elastic layer 301 or the protective layer 303. An upper surface of the arch support 305 may be placed against the foot and a lower surface of the arch support 305 may by in physical contact with the elastic layer 301 or the protective layer 303 and the arch support 305 but not be secured to the elastic layer 301 or the protective layer 303. Thus, the arch support 305 can freely slide against the elastic layer 301 or the protective layer 303.

Figure 42:
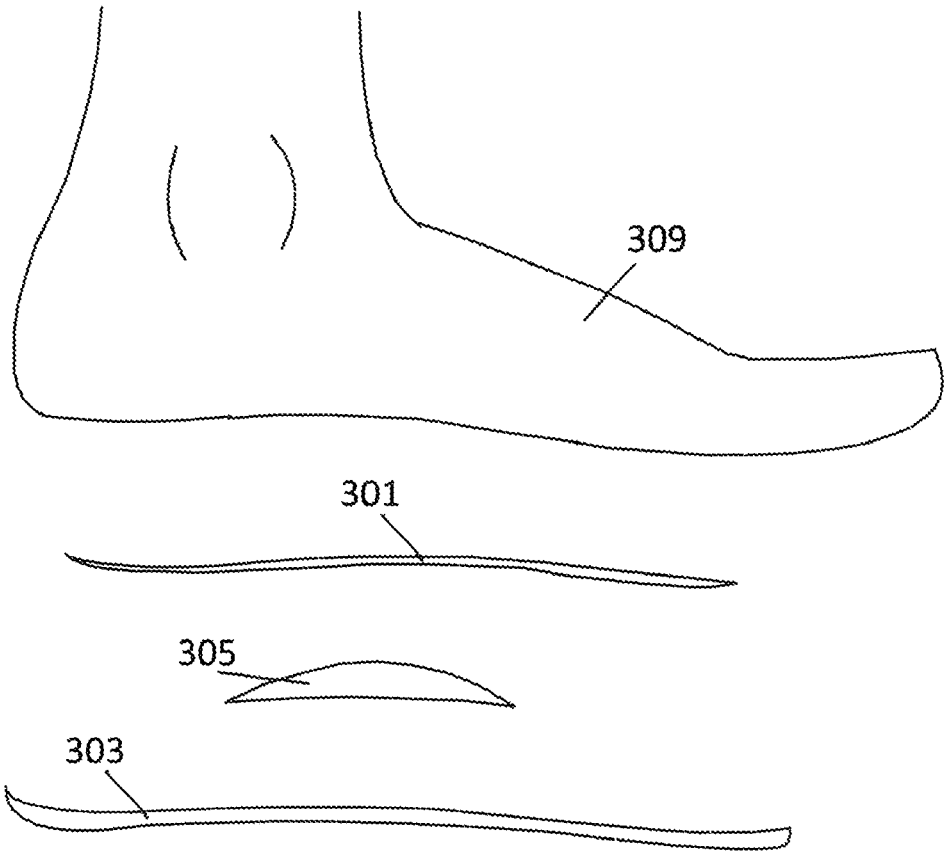
FIG. 42 illustrates an exploded side view of a foot and adhesive footwear components.
Figure 43:
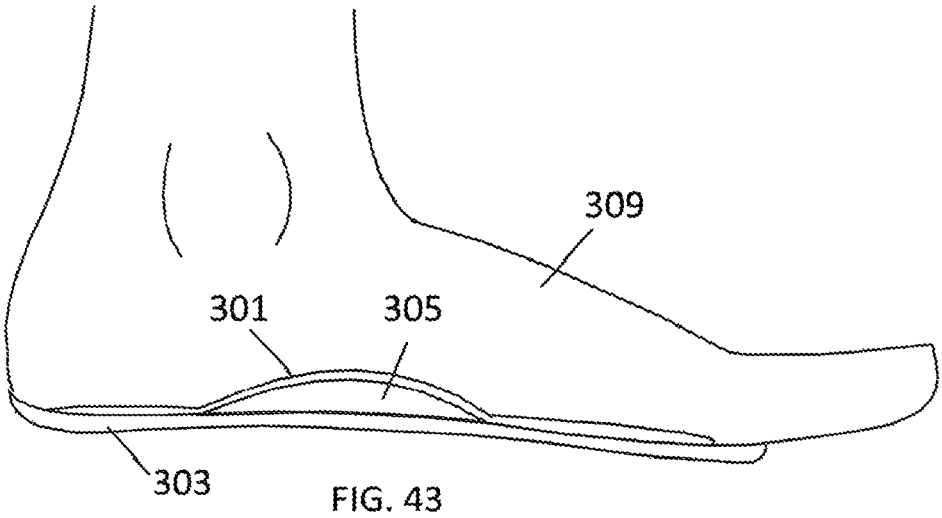
FIG. 43 illustrates an assembled side view of a foot and adhesive footwear.

With reference to FIG. 42 an exploded side view of an embodiment of an adhesive footwear 307 is illustrated which includes the arch support structure 305 is between the protective layer 303 and the elastic layer 301. The foot 309 can be measured and the protective layer 303, elastic layer 301 and arch support structure 305 can be selected or manufactured based upon the foot measurements. The elastic layer 301 and the protective layer 303 can extend to the heel to the lateral border of the fifth metatarsophalangeal (MTP) joint and the first MTP joint. FIG. 43 illustrates the assembled adhesive footwear 307 attached to the foot 309. The adhesive material around the elastic layer 301 can be secured to the foot 309 to hold the footwear 307 in place.

In other embodiments of the footwear, the arch support 305 may be secured to the foot and not directly bonded with an adhesive to the elastic layer 301 or the protective layer 303. FIGS. 44-48, the footwear includes the protective layer 303, the elastic layer 301, the elastic arch support adhesive strip 308, and the arch support 305 can be used in various combinations. In other embodiments, the footwear can include different combinations of components selected from: the protective layer 303, the elastic layer 301, the elastic arch support adhesive strip 308, and the arch support 305 that may or may not include the elastic layer 301 and the arch support 305. The footwear illustrated in FIGS. 49-53 includes the protective layer 303, the elastic arch support adhesive strip 308, and the arch support 305 but does not include the elastic layer 301. The footwear illustrated in FIGS. 54-57 includes the protective layer 303, the elastic layer 301, and the elastic arch support adhesive strip 308, but does not include the arch support 305. In this embodiment, the elastic arch support adhesive strip 308 functions as the arch support. The footwear illustrated in FIGS. 58-61 includes the protective layer 303 and the elastic arch support adhesive strip 308, but does not include the elastic layer 301 or the arch support 305. In this embodiment, the elastic arch support adhesive strip 308 also functions as the arch support.

Figure 44:
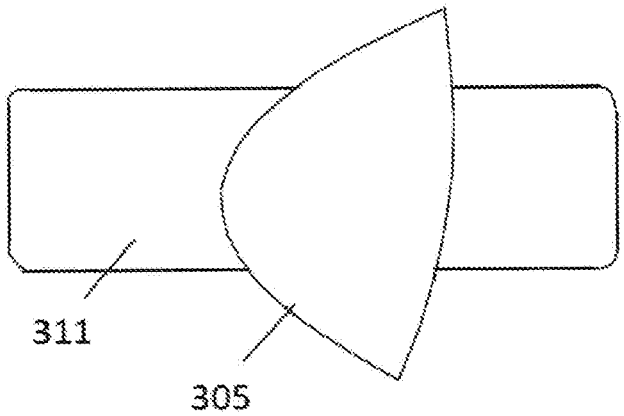
FIG. 44 illustrates a top view of an arch support structure over a strip of adhesive.

FIG. 44 illustrates the arch support 305 attached to an elastic arch support adhesive strip 308. The arch support 305 can be a three dimensional elastic structure that can have a thicker center portion and tapered edges that are placed against the center of the foot and the middle region of the footwear. In other embodiments, the arch support 305 can be a thin flexible or a rigid structure that can have a uniform thickness. The arch support 305 can have a convex upper surface and can be elastically deformed and compressed downward when the arch of the foot presses against the arch support 305. The arch support 305 can then expand upward in an elastic manner as the arch of the foot moves upward. The upper surface of the arch support 305 can be a smooth surface that does not have any adhesives which can allow the bottom of the foot to easily slide against the upper surface of the arch support 305.

The elastic arch support adhesive strip 308 can have an adhesive material is on the upper surface that is secured to the bottom of the arch support 305 and the bottom of the foot. The adhesive material is not on the lower surface of the elastic arch support adhesive strip 308 so the strip can slide against the upper surface of the elastic layer (301 in FIG. 45). The adhesive is also not on the upper surfaces of the arch support 305. Because the upper surfaces of the arch support 305 can be smooth, it can slide against the bottom of the foot's arch and the adhesive is not on the middle portion of the upper surface of the elastic layer (304 in FIG. 45) so both the arch support 305 and the elastic arch support adhesive strip 308 can slide against the middle non-adhesive region of the protective layer.

Figure 45:
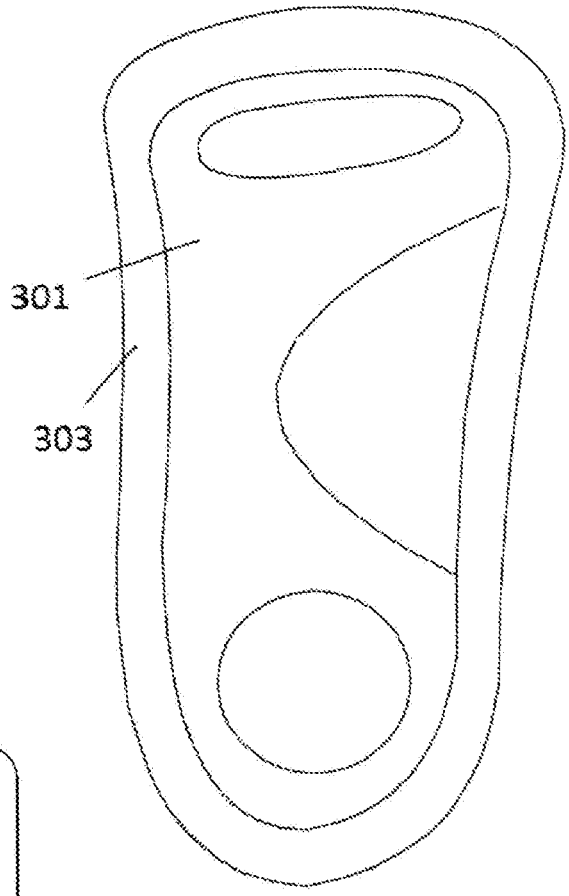
FIG. 45 illustrates a top view of an elastic layer and protective layer assembly.

FIG. 45 illustrates an embodiment of an elastic layer 301 and protective layer 303 assembly that does not include an arch support structure. The assembly elastic layer 301 and the protective layer 303 can be flat over the arch support area. Adhesive material 311 can be placed on a front adhesive region 302 and a rear adhesive region 306 towards a heel end on the upper surface of the elastic layer 301 of the footwear. The front adhesive region 302 can be elongated in a shape that extends across the width of the elastic layer 301. The rear adhesive region 306 can be circular in shape. The upper surface of the elastic layer 301 can also have a smooth middle non-adhesive region 304 between the front adhesive region 302 and a rear adhesive region 306. The foot can be attached to the adhesive materials 311 at the front adhesive region 302 and a rear adhesive region 306 and the foot can slide against and/or freely separate from the middle non-adhesive region 304 of the elastic layer 301.

Figure 46:
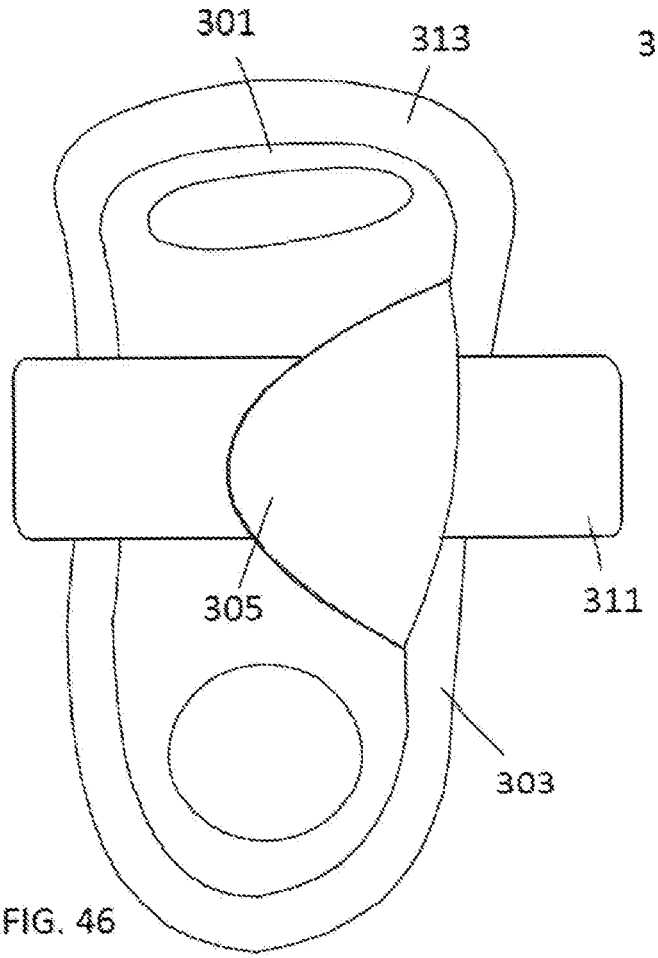
FIG. 46 illustrates a top view of an embodiment of the assembled adhesive footwear.

FIG. 46 illustrates a top view of the arch support 305 and the elastic arch support adhesive strip 308 over the middle non-adhesive region 304 of the elastic layer 301 prior to attaching these components to a foot. The upper surface of the elastic arch support adhesive strip 308 has an adhesive surface and the lower surface of the elastic arch support adhesive strip 308 has a non-adhesive surface. The upper surface of the elastic arch support adhesive strip 308 can be adhesively attached to the arch support 305 and the ends of the elastic arch support adhesive strip 308 can be adhesively attached to the foot to hold the arch support 305 to the arch of the foot. However, the arch support 305 and the elastic arch support adhesive strip 308 can be physically independent of the elastic layer 301 and the protective layer 303.

The upper surface of the protective layer 313 can also be secured to the lower surface of the elastic layer 301. The adhesive material 311 can be secured at the front adhesive region 302 and at the rear adhesive region 306 on the upper surface of the elastic layer 301. The upper surface of the elastic layer 301 at the middle non-adhesive region 304 is smooth and non-adhesive which allows the foot and the lower surfaces of the arch support 305 and the elastic arch support adhesive strip 308 to slide against the elastic layer 301. The adhesion of the footwear only at the front adhesive region 302 and at the rear adhesive region 306 creates a dynamic suspension in a horizontal plane which provides support and protection when the foot contacts the ground and dynamically alters this support as the user walks or runs.

Figure 47:
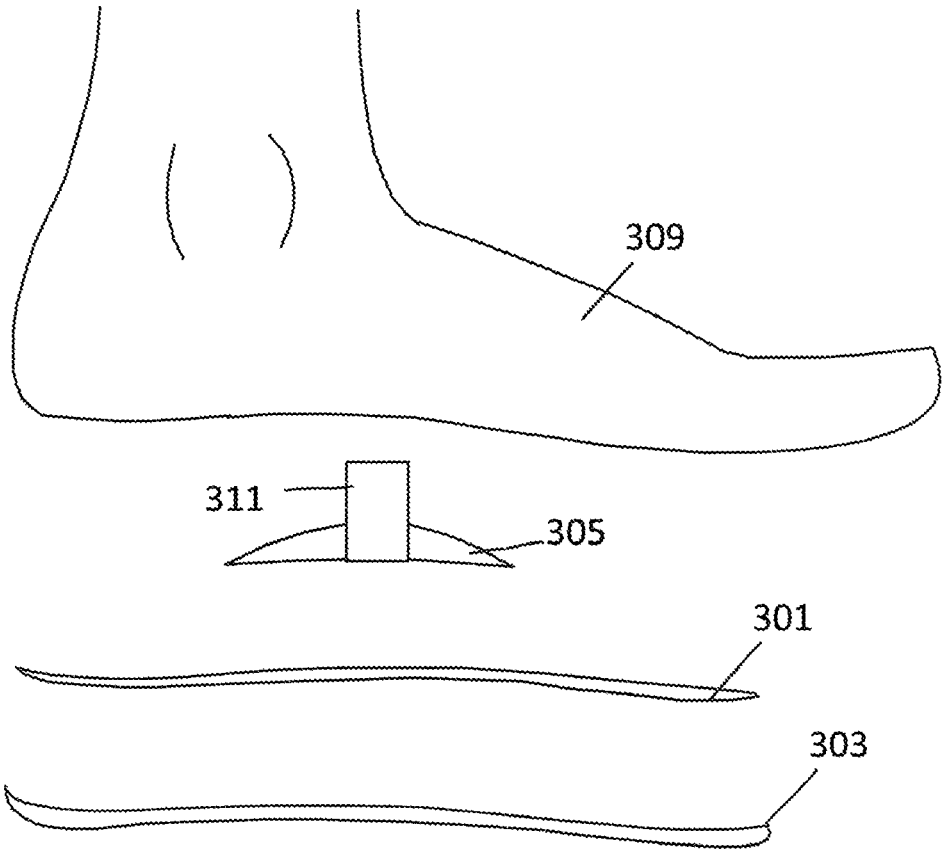
FIG. 47 illustrates an exploded side view of a foot and adhesive footwear components.

FIG. 47 illustrates an exploded side view of the adhesive footwear components. The arch support structure 305 is attached directly to the foot 309 with the elastic arch support adhesive strip 308. The elastic arch support adhesive strip 308 may only have an adhesive on the upper surface, and the lower surface can be smooth and not include an adhesive material. The elastic layer 301 is adhesively bonded to the protective layer 303 are attached as a separate structure to the foot 309 from the arch support structure 305 and the elastic arch support adhesive strip 308.

Figure 48:
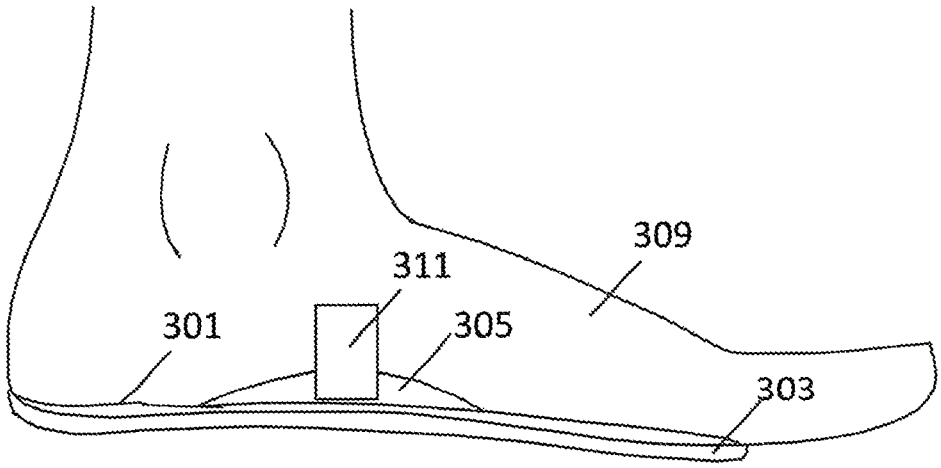
FIG. 48 illustrates an assembled side view of a foot and adhesive footwear.

With reference to FIG. 48 an assembled side view of the adhesive footwear 313 attached to a foot 309 is illustrated. The arch support 305 is secured directly to the foot 309 with the elastic arch support adhesive strip 308. The upper layer of the arch support 305 can be smooth and non-adhesive so the arch support 305 can slide against the arch of the foot. The elastic layer 301 and the protective layer 303 assembly is attached to the foot 309 by the adhesives at the front adhesive region and the rear adhesive region on the protective layer 303. The lower surface of the arch support 305 and the center portions of the foot 309 can slide on the upper surface of the elastic layer 301 at the middle non-adhesive region when the user walks and the foot 309 moves.

Figure 49:
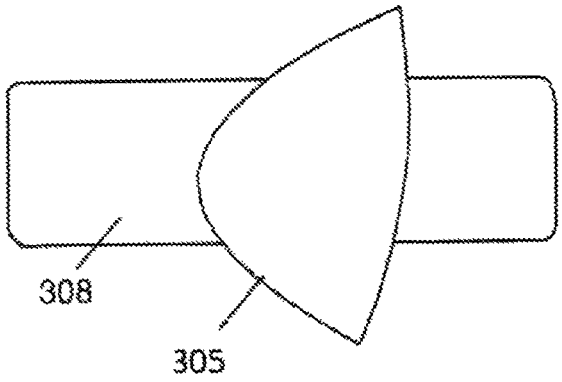
FIG. 49 illustrates a top view of an arch support structure over a strip of adhesive.

FIG. 49 illustrates the arch support 305 attached to an elastic arch support adhesive strip 308. The arch support 305 can be a three dimensional elastic structure that can have a thicker center portion and tapered peripheral edges. In other embodiments, the arch support 305 can be a thin flexible structure that can have a uniform thickness that can be compressed downward elastically. The upper surface of the arch support 305 can be placed against the arch of the foot and the lower surface of the arch support 305 can be placed against middle non-adhesive region of the footwear. The arch support 305 can be secured to the foot with just the elastic arch support adhesive strip 308. While the elastic arch support adhesive strip 308 is shown on a middle portion of the arch support 305, in other embodiments, the elastic arch support adhesive strip 308 can be in contact with the entire lower surface of the arch support 305.

Figure 50:
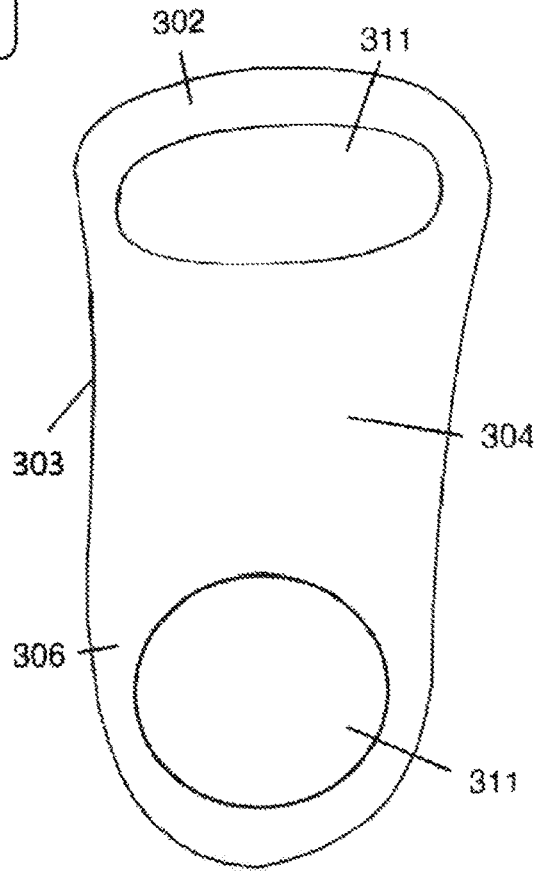
FIG. 50 illustrates a top view of an elastic layer and protective layer assembly.

FIG. 50 illustrates an embodiment of an adhesive material 311 and protective layer 303 assembly that does not include an integrated arch support structure. The protective layer 303 can be flat over the arch support area. Adhesive material 311 can be placed on a front adhesive region 302 and a rear adhesive region 306 towards a heel end on the upper surface of the elastic layer 301 of the footwear. The front adhesive region 302 can be elongated in a shape that extends across most of or the entire width of the elastic layer 301. The rear adhesive region 306 can be circular in shape. The upper surface of the elastic layer 301 can also have a smooth middle non-adhesive region 304 between the front adhesive region 302 and a rear adhesive region 306. The foot can slide against and/or freely separate from the middle non-adhesive region 304 of the elastic layer 301. In this embodiment, the protective layer 303 can provide some elasticity for cushioning the foot from impacts and can also provide protection for the foot.

Figure 51:
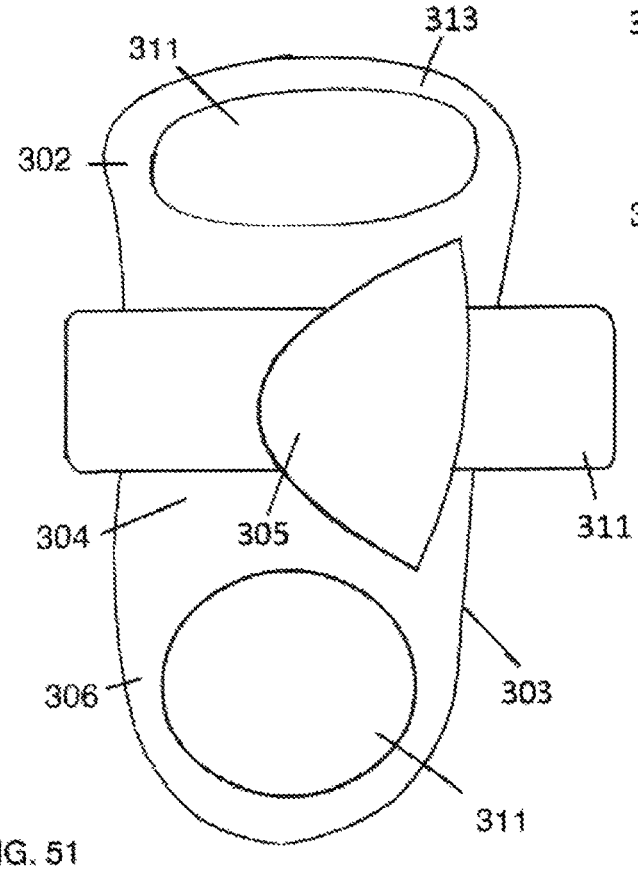
FIG. 51 illustrates a top view of an embodiment of the assembled adhesive footwear.

FIG. 51 illustrates a top view of the arch support 305 and the elastic arch support adhesive strip 308 over the middle non-adhesive region 304 of the protective layer 303 prior to attaching these components to a foot. The upper surface of the elastic arch support adhesive strip 308 can have an adhesive surface and the lower surface of the elastic arch support adhesive strip 308 can have a smooth non-adhesive surface. The upper surface of the elastic arch support adhesive strip 308 can be adhesively attached to the arch support 305 and the ends of the elastic arch support adhesive strip 308 can be adhesively attached to the foot to hold the arch support 305 to the arch of the foot. The arch support 305 and the elastic arch support adhesive strip 308 are attached to the lower surface of the foot and can slide over the middle non-adhesive region 304 of the protective layer 301.

Figure 52:
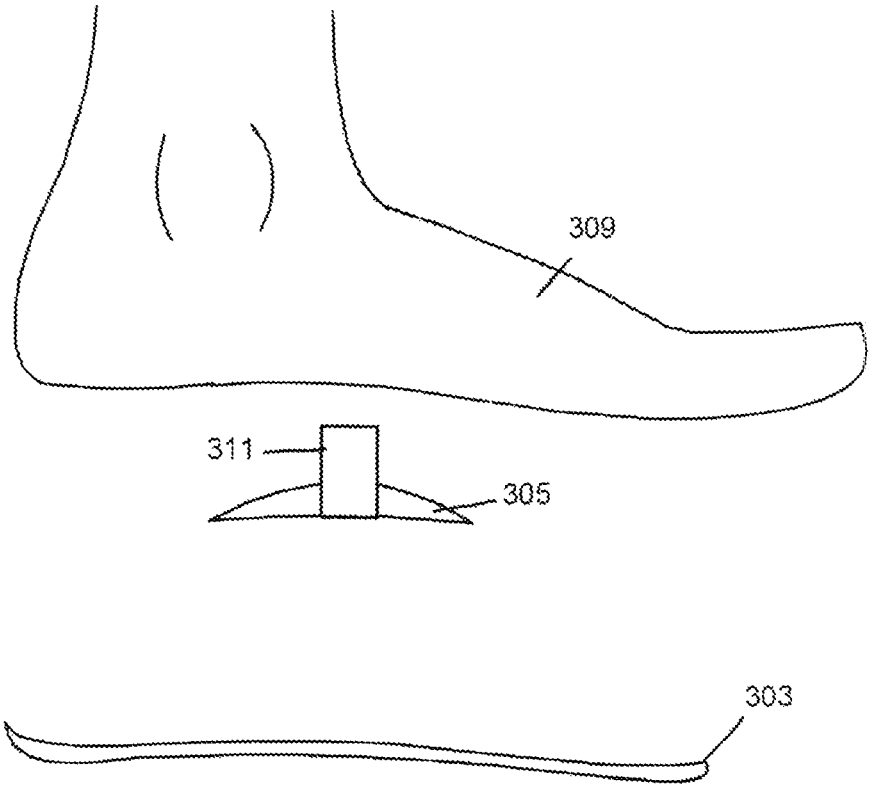
FIG. 52 illustrates an exploded side view of a foot and adhesive footwear components.
Figure 53:
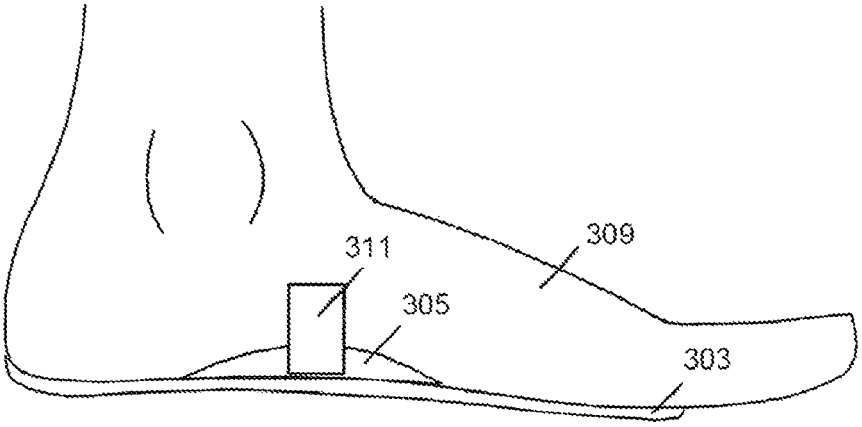
FIG. 53 illustrates an assembled side view of a foot and adhesive footwear.

FIG. 52 illustrates an exploded side view of the adhesive footwear components. The arch support structure 305 is attached directly to the foot 309 with the elastic arch support adhesive strip 308. The elastic arch support adhesive strip 308 may only have an adhesive on the upper surface, and the lower surface does not include an adhesive material. With reference to FIG. 53 an assembled side view of the adhesive footwear attached to a foot 309 is illustrated. The arch support 305 is secured directly to the foot 309 with the elastic arch support adhesive strip 308. The upper layer of the arch support 305 can be smooth and non-adhesive so the arch support 305 can slide against the lower arch of the foot. The lower surface of the arch support 305, the lower surface of the elastic arch support adhesive strip 308 and the center portions of the foot 309 can slide on the upper surface of the protective layer 303 at the middle non-adhesive region when the user walks and the foot 309 moves. The protective layer 303 assembly is attached to the foot 309 by the adhesives at the front adhesive region and the rear adhesive region on the protective layer 303 shown in FIGS. 50 and 51. The adhesives at the front adhesive region and the rear adhesive region on the protective layer 303 can cause tension and compression on the foot as the protective layer 303 bends and flattens during foot movement which creates a dynamic suspension in a horizontal plane.

In other embodiments, the inventive footwear may only use the elastic arch support adhesive strip 308 as the arch support without any other arch support structures. The elastic arch support adhesive strip 308 can be made of an elastic material that is adhesively attached around at least partially around the circumference of the foot. The outer surface of the elastic arch support adhesive strip 308 can be smooth. Because the elastic arch support adhesive strip 308 is elastic, it can conform to the outer surface of the foot at the arch area. By wrapping around the foot and adhesively securing to the foot, the elastic arch support adhesive strip 308 can provide physical support to the muscles, tendons, and ligaments on the arch region of the foot.

In different embodiments, the elastic arch support adhesive strip 308 can be a high strength elastic material. For example, adhesive tapes such as KT Tape® can be used as the elastic arch support adhesive strip 308. In an embodiment, the elastic arch support adhesive strip 308 can include cotton fibers with durable synthetic fabric having strong elastic cores. Both the cotton and synthetic material fibers can create unidirectional elasticity which allows the elastic arch support adhesive strip 308 to stretch in length but not in width. As a result, the elastic fibers provide stable support without restricting range of motion. The fibers of the elastic arch support adhesive strip 308 can also allow for moisture release which is critical for comfort and wearability. The elastic arch support adhesive strip 308 can have an adhesive that is latex-free, hypo-allergenic, and designed to last through humidity, sweat and showers, and multiple days of wear.

The user can adjust the upward force provided by the elastic arch support adhesive strip 308 by adjusting the tension applied to the foot. If more support is desired, the user can apply more tension of the elastic arch support adhesive strip 308. Conversely, if less support is desired, the user can apply less tension of the elastic arch support adhesive strip 308.

Figure 54:
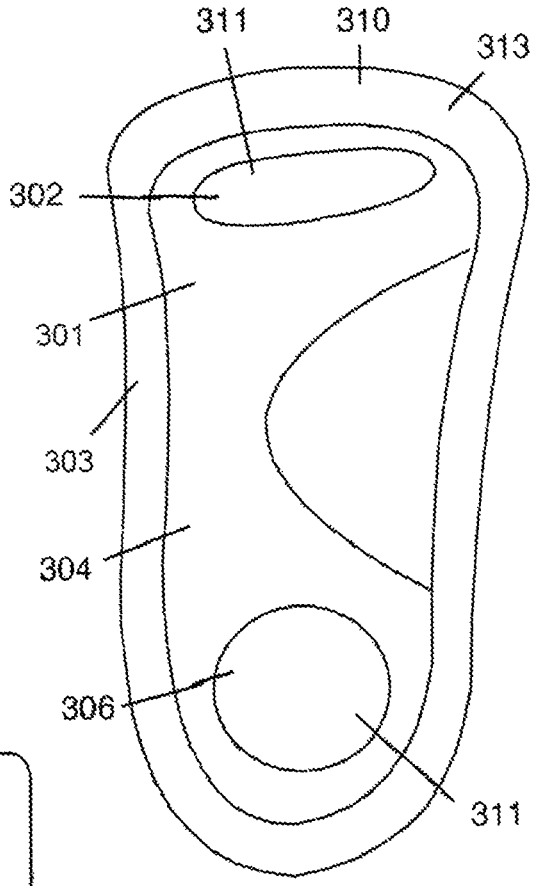
FIG. 54 illustrates a top view of an elastic layer and protective layer assembly.

FIG. 54 illustrates an embodiment of an elastic layer 301 and protective layer 303 assembly that does not include an arch support structure. The assembly elastic layer 301 and the protective layer 303 can be flat over the arch support area. Adhesive material 311 can be placed on a front adhesive region 302 and a rear adhesive region 306 towards a heel end on the upper surface of the elastic layer 301 of the footwear. The front adhesive region 302 can be elongated in a shape that extends across the width of the elastic layer 301. The rear adhesive region 306 can be circular in shape. The upper surface of the elastic layer 301 can also have a smooth middle non-adhesive region 304 between the front adhesive region 302 and a rear adhesive region 306. The foot can be attached to the adhesive materials 311 at the front adhesive region 302 and a rear adhesive region 306 and the foot can slide against and/or freely separate from the middle non-adhesive region 304 of the elastic layer 301.

Figure 55:
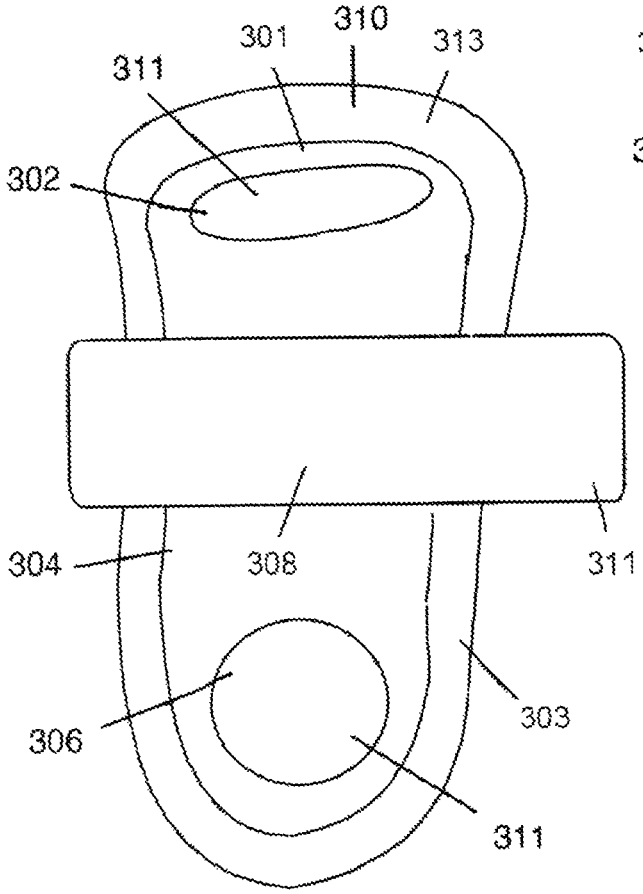
FIG. 55 illustrates a top view of an embodiment of the assembled adhesive footwear.

FIG. 55 illustrates a top view of the elastic arch support adhesive strip 308 over the middle non-adhesive region 304 of the elastic layer 301 prior to attaching these components to a foot. The upper surface of the elastic arch support adhesive strip 308 has an adhesive surface and the lower surface of the elastic arch support adhesive strip 308 has a non-adhesive surface. The upper surface of the elastic arch support adhesive strip 308 can be adhesively attached to the arch area of the foot to support the muscles, tendons, and ligaments on the arch region of the foot. However, the elastic arch support adhesive strip 308 can be physically independent of the elastic layer 301 and the protective layer 303.

The upper surface of the protective layer 313 can also be secured to the lower surface of the elastic layer 301. The adhesive material 311 can be secured at the front adhesive region 302 and at the rear adhesive region 306 on the upper surface of the elastic layer 301. The upper surface of the elastic layer 301 at the middle non-adhesive region 304 is smooth and non-adhesive which allows the foot and the lower surfaces of the arch support 305 and the elastic arch support adhesive strip 308 to slide against the elastic layer 301. The adhesion of the footwear only at the front adhesive region 302 and at the rear adhesive region 306 creates a dynamic suspension in a horizontal plane which provides support and protection when the foot contacts the ground and dynamically alters this support as the user walks or runs.

Figure 56:
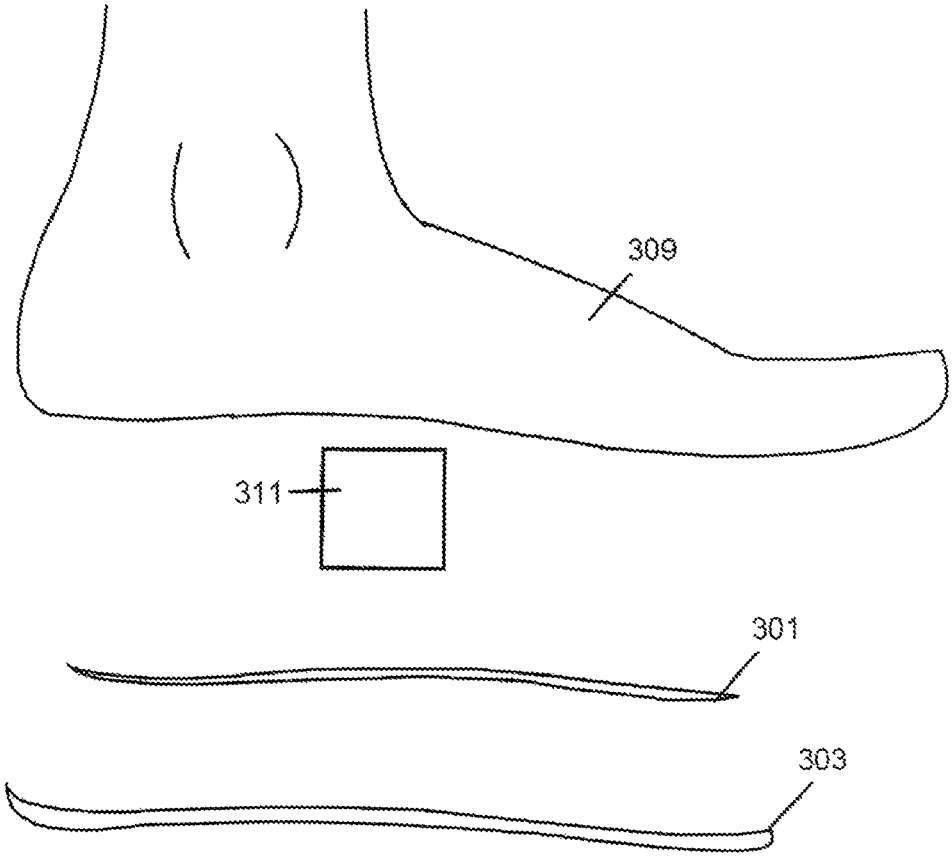
FIG. 56 illustrates an exploded side view of a foot and adhesive footwear components.

FIG. 56 illustrates an exploded side view of the adhesive footwear components. The elastic arch support adhesive strip 308 is attached directly to the foot 309 and may only have an adhesive on the upper surface while the lower surface can be smooth and not include an adhesive material. The elastic layer 301 is adhesively bonded to the protective layer 303 and attached as a separate structure to the foot 309 from the elastic arch support adhesive strip 308.

Figure 57:
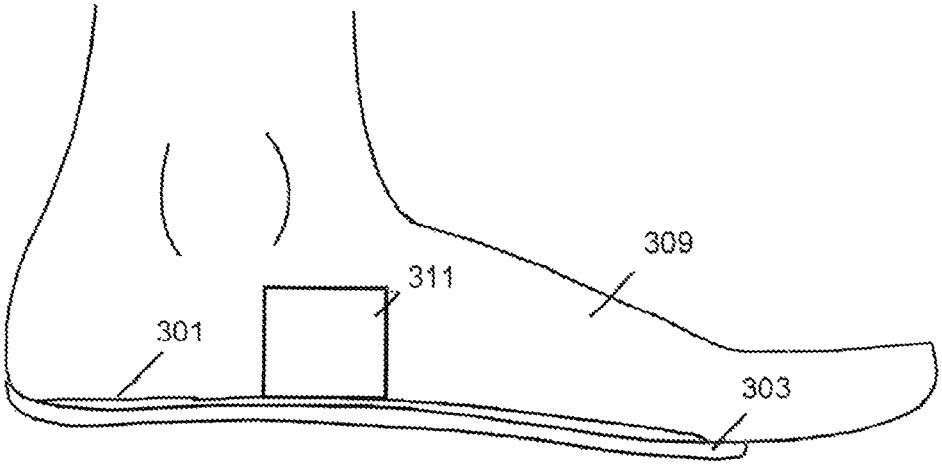
FIG. 57 illustrates an assembled side view of a foot and adhesive footwear.

With reference to FIG. 57 an assembled side view of the adhesive footwear 313 attached to a foot 309 is illustrated. The elastic arch support adhesive strip 308 is secured directly to the foot 309. The exposed outer lower surface can be smooth and non-adhesive so the elastic arch support adhesive strip 308 can slide against the middle region of the elastic layer 301. The elastic layer 301 and the protective layer 303 assembly is attached to the foot 309 by the adhesives at the front adhesive region and the rear adhesive region on the elastic layer 301. The center portions of the foot 309 can slide on the upper surface of the elastic layer 301 at the middle non-adhesive region when the user walks and the foot 309 moves.

Figure 58:
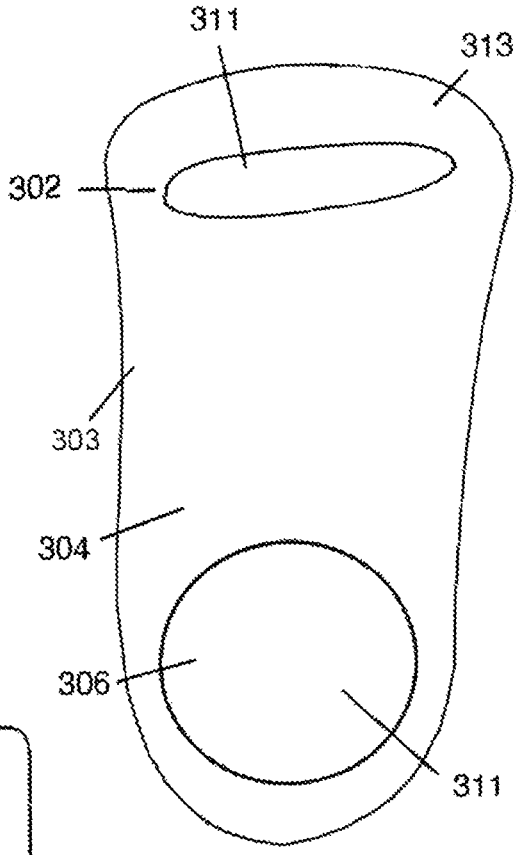
FIG. 58 illustrates a top view of an elastic layer and protective layer assembly.

FIG. 58 illustrates an embodiment of protective layer 303 assembly that only uses the elastic arch support adhesive strip as the arch support. The protective layer 303 can be flat over the arch support area and adhesive material 311 can be placed on a front adhesive region 302 and a rear adhesive region 306 towards a heel end on the upper surface of the protective layer 303 of the footwear. The front adhesive region 302 can be elongated in a shape that extends across the width of the protective layer 303. The rear adhesive region 306 can be circular in shape or any other suitable shape. The upper surface of the protective layer 303 can also have a smooth middle non-adhesive region 304 between the front adhesive region 302 and a rear adhesive region 306. The foot can be attached to the adhesive materials 311 at the front adhesive region 302 and a rear adhesive region 306 and the foot can slide against and/or freely separate from the middle non-adhesive region 304 of the protective layer 303. In this embodiment, the protective layer 303 can provide some elasticity for cushioning the foot from impacts and can also provide protection for the foot.

Figure 59:
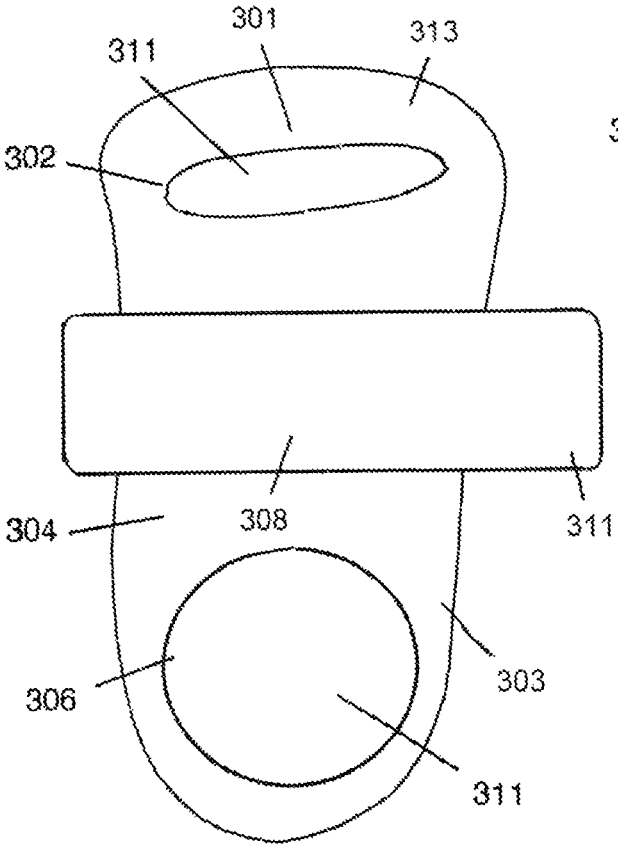
FIG. 59 illustrates a top view of an embodiment of the assembled adhesive footwear.

FIG. 59 illustrates a top view of the elastic arch support adhesive strip 308 over the middle non-adhesive region 304 of the elastic layer 301 prior to attaching these components to a foot. The upper surface of the elastic arch support adhesive strip 308 has an adhesive surface and the lower surface of the elastic arch support adhesive strip 308 has a non-adhesive surface. The upper surface of the elastic arch support adhesive strip 308 can be adhesively attached to the arch area of the foot to support the muscles, tendons, and ligaments on the arch region of the foot. However, the elastic arch support adhesive strip 308 can be physically independent of the protective layer 303.

The adhesive material 311 can be secured at the front adhesive region 302 and at the rear adhesive region 306 on the upper surface of the protective layer 303 of the footwear 313. The upper surface of the protective layer 303 at the middle non-adhesive region 304 is smooth and non-adhesive which allows the foot and the lower surfaces of the arch support 305 and the elastic arch support adhesive strip 308 to slide against the middle non-adhesive region 304 of the protective layer 303. The adhesion of the footwear only at the front adhesive region 302 and at the rear adhesive region 306 creates a dynamic suspension in a horizontal plane which provides support and protection when the foot contacts the ground and dynamically alters this support as the user walks or runs.

Figure 60:
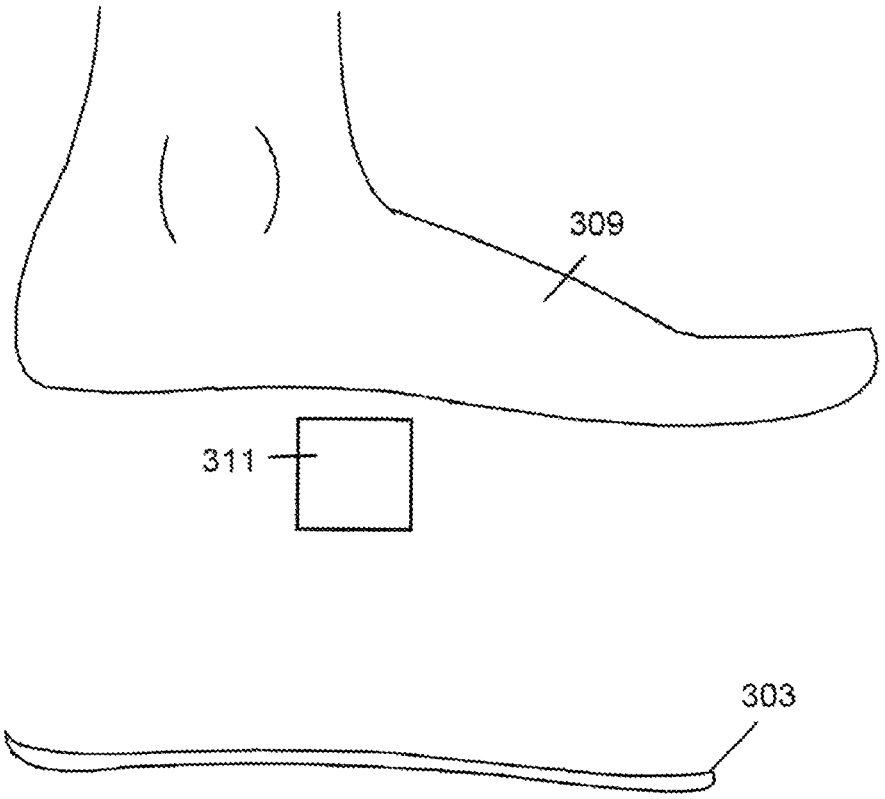
FIG. 60 illustrates an exploded side view of a foot and adhesive footwear components.
Figure 61:
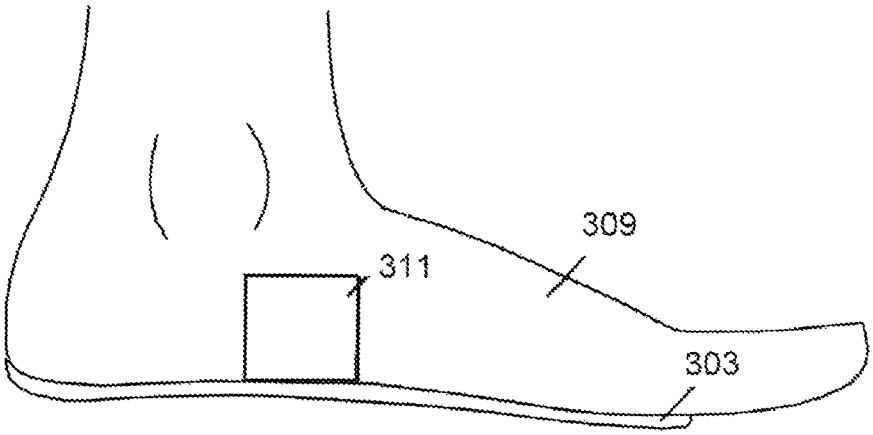
FIG. 61 illustrates an assembled side view of a foot and adhesive footwear.

FIG. 60 illustrates an exploded side view of the adhesive footwear components. The elastic arch support adhesive strip 308 is attached directly to the foot 309 and may only have an adhesive on the upper surface while the lower surface can be smooth and not include an adhesive material. The protective layer 303 and attached the front adhesive region and at the rear adhesive region as the described. The protective layer 303 and the elastic arch support adhesive strip 308 are separate structures that not physically coupled to each other but are independently coupled to the foot 309. With reference to FIG. 61 an assembled side view of the adhesive footwear 313 attached to a foot 309 is illustrated. The elastic arch support adhesive strip 308 is secured directly to the foot 309. The exposed outer lower surface can be smooth and non-adhesive so the elastic arch support adhesive strip 308 can slide against the middle region of the protective layer 303. The protective layer 303 is attached to the foot 309 by the adhesives at the front adhesive region and the rear adhesive region. The center portions of the foot 309 and the outer lower surface of the elastic arch support adhesive strip 308 can slide on the upper surface of the protective layer 303 at the middle non-adhesive region when the user walks and the foot 309 moves.

Figure 62:
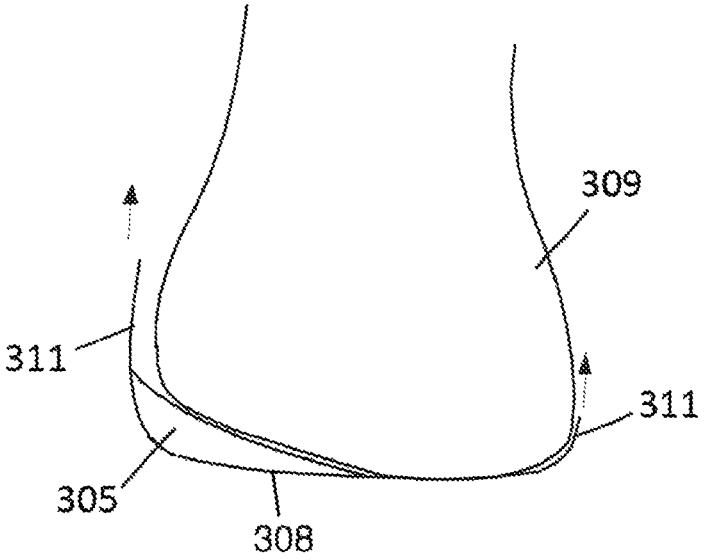
FIGS. 62 and 63 illustrate rear views of an arch support structure placed against an arch of a foot.
Figure 63:
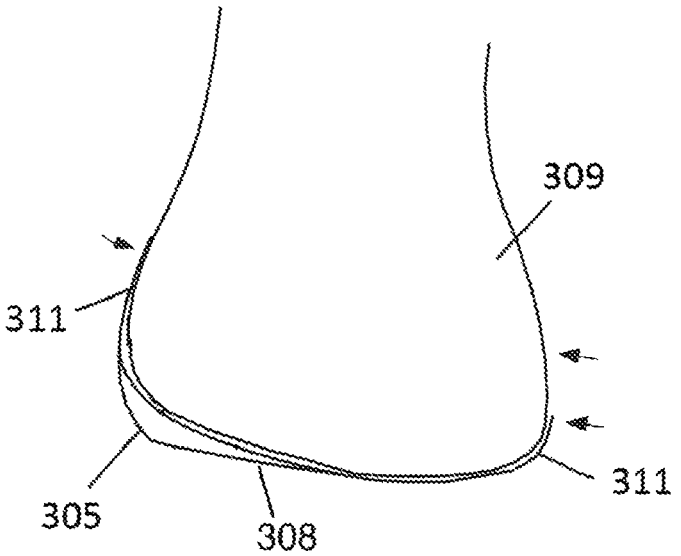

With reference to FIGS. 62 and 63 a rear view of a right foot 309 and the arch support 305 and an elastic arch support adhesive strip 308 having adhesive strip 311 at the ends is illustrated. In FIG. 62, the arch support 305 is placed against the arch of the foot 309 and the ends of the adhesive strip 311 of the elastic arch support adhesive strip 308 are pulled upward. With reference to FIG. 63, the arch support 305 is compressed by the elastic arch support adhesive strip 308 against the arch area of the foot 309 to the desired tension. At the desired tension and the desired compression of the arch support 305 against the foot, the ends of the adhesive strip 311 are secured to the foot 309. Once the arch support 305 is secured to the foot 309, the elastic layer 301 and the protective layer 303 assembly can be attached to the foot 309 as illustrated in FIGS. 48 and 53.

Figure 64:
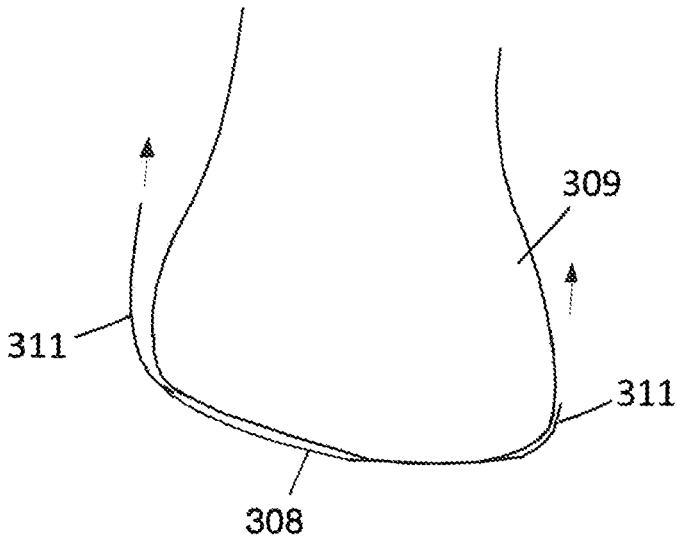
FIGS. 64 and 65 illustrate rear views of an elastic arch support adhesive strip placed against an arch of a foot.
Figure 65:
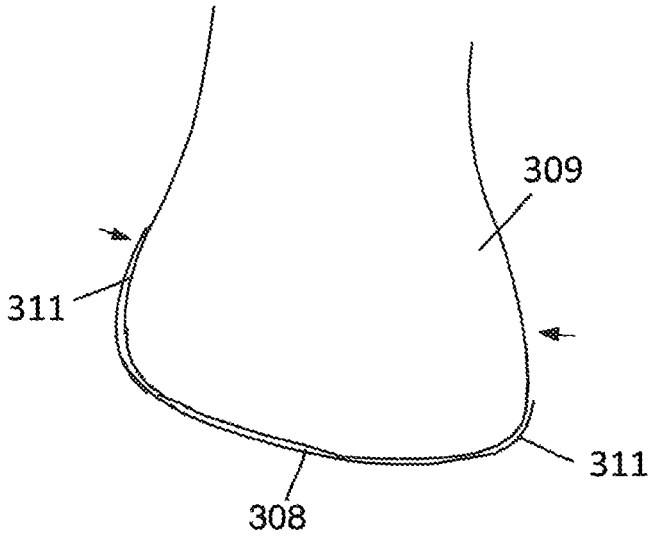

With reference to FIGS. 64 and 65 a rear view of a right foot 309 and the elastic arch support adhesive strip 308 having adhesive strip 311 at the ends is illustrated. In FIG. 62, the elastic arch support adhesive strip 308 is placed against the arch of the foot 309 and the ends of the adhesive strip 311 of the elastic arch support adhesive strip 308 are pulled upward. With reference to FIG. 63, the elastic arch support adhesive strip 308 is stretched against the arch area of the foot 309 to the desired tension. At the desired tension, the ends of the adhesive strip 311 are secured to the foot 309. Once the elastic arch support adhesive strip 308 is secured to the foot 309, the footwear assembly that can include the elastic layer 301 and the protective layer 303 can be attached to the foot 309 as illustrated in FIGS. 57 and 61.

Figure 66:
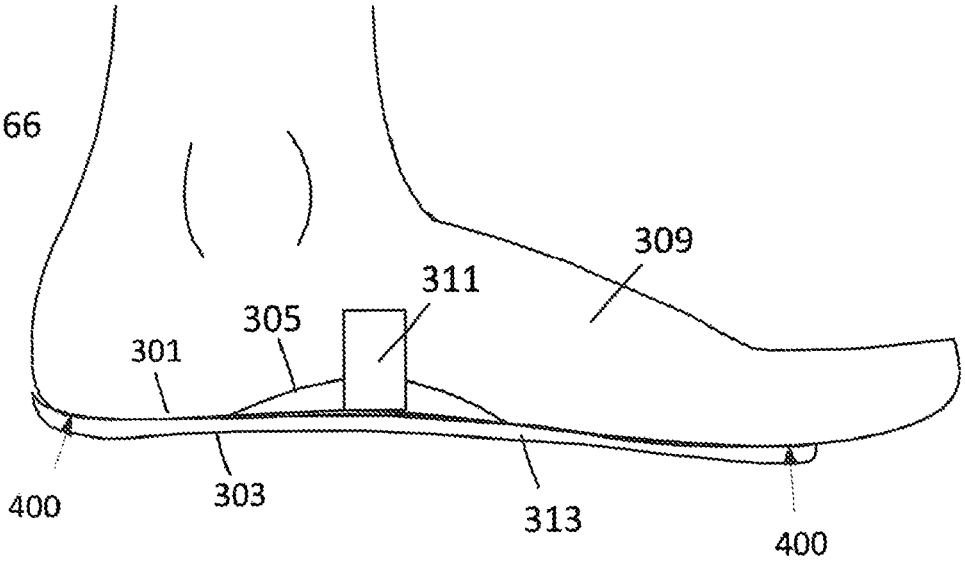

FIG. 66 illustrates a side view of an embodiment of the multi-layer adhesive footwear 313 attached to the user's foot 309. The lower adhesive attaches to the foot as indicated by the arrows at the heel and the base of the toes which can be a metatarsophalangeal (MTP) joint area of a foot. As discussed, in this embodiment, the sole does not extend forward beyond the base of the toes. The adhesive strip 308 secures the arch support 305 to the arch portion of the foot and the upper surface of the arch support 305 does not include any adhesive material. The upper surface of the arch support 305 can slide against the bottom of the arch support of the user's foot.

In the illustrated embodiments, the arch support structure 305 coupling to the foot 309 is completely independent of the footwear 313. The bottom of the adhesive strip 308 does not include and adhesive and the arch support 305 and the bottom surface of the foot over the elastic layer 301 can slide against the elastic layer 301. The protective layer 303 can be coupled to the foot 309 at the adhesive contact points 400 which include the rear heel and the front portions attached to the MTP joint area of a foot of the protective layer 303. The perimeter of the footwear 313 can be analogous to a bow that moves between flat and curved positions. The foot wear can be fully expanded in the flat position resulting in tension in the foot 309.

Figure 67:
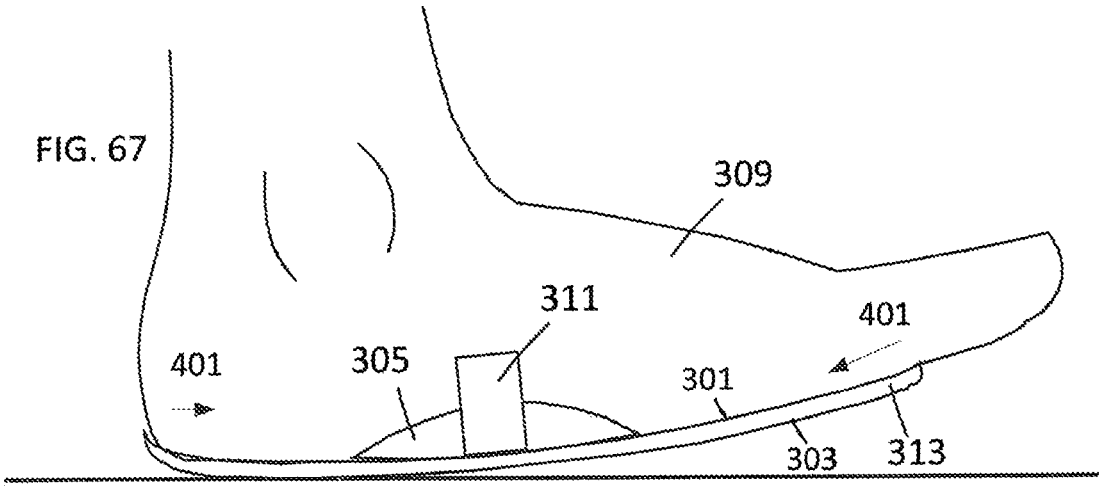

With reference to FIG. 67, when the user walks and the heel strikes the ground, resulting in dorsal flexion of the foot. The adhesive bonds at the base of the toes and heel will cause the footwear 313 to bow which creates compression in the foot 309 as illustrated by the inward pointing arrows 401 at the ends of the adhesive footwear 313. The strip of adhesive material 308 can be applied over the arch support 305 which can provide additional compression of the arch support 305 against the foot 309. Because the arch support 305 is independently secured to the foot 309 with the adhesive strip 308, the compressive force against the foot 309 will remain constant regardless of the position of the foot 309.

Figure 68:
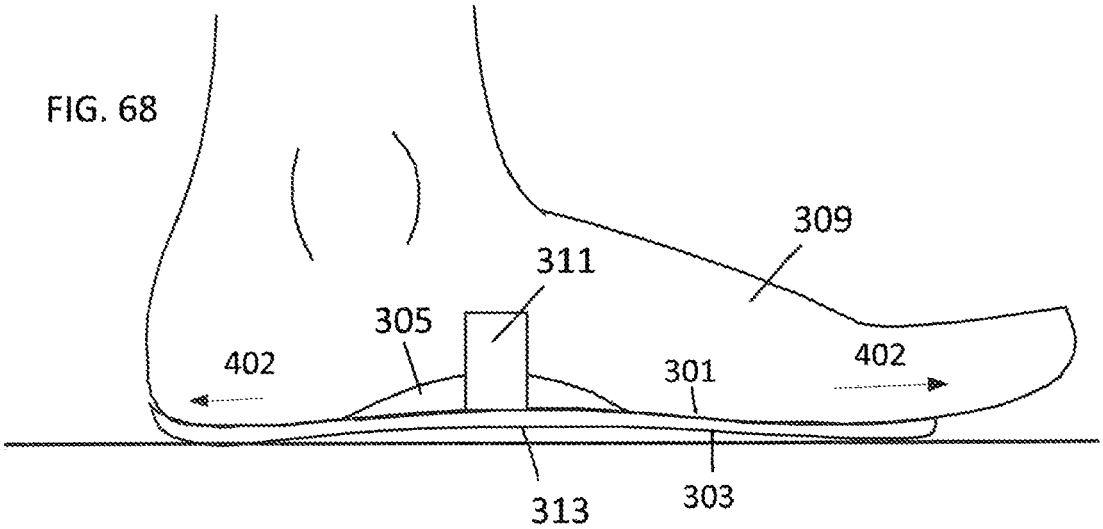

With reference to FIG. 68, the walking user has transitioned from the dorsal flexion to a standing on the adhesive footwear 313 on a ground which is in a flat position. The adhesive bond at the base of the toes by the MTP joint area of a foot and heel will create outward pulling forces 402 which result in tension in the foot 309 as illustrated by the outward pointing arrows 402 at the ends of the adhesive footwear 313 where the exposed protective layer 303 is adhesively attached to the front and rear portions of the protective layer 303. With reference to FIG. 69 the user has transitioned from a standing position to a plantar flexion as the step is completed and the forefoot pushes off the ground. The footwear 313 bows to create compression force 401 in the adhesive footwear 313 as illustrated by the inward pointing arrows at the ends of the adhesive footwear 313.

FIGS. 66-69 illustrate the dynamic suspension in a horizontal plane of the adhesive footwear 313 which provides support and protection when the foot 309 contacts the ground and dynamically alters this support as the user walks or runs. When the footwear 313 is curved with the lower surface of the protective layer 303 creating a convex surface and the upper layer of the elastic layer 301 creating a concave surface when the toes of the foot 309 are lifted off the ground as shown in FIG. 67 and when the heel of the foot 309 is lifted off the ground as shown in FIG. 69, the adhesive attachments at the front adhesive region and rear adhesive region of the footwear 313 with a non-adhesive region between the front adhesive region and rear adhesive region create a compression force on the foot 309 between the heel and MTP joint area of the foot. Conversely when the foot 309 and footwear 313 are flat on the ground, the adhesive attachments at the front and rear of the footwear 313 create a tension force 402 on the foot 309 as shown in FIG. 68 where the lower surface of the protective layer 303 and the upper layer of the elastic layer 301 are substantially planar. The dynamic suspension provides compression and tension on the sole of the foot which includes the plantar fascia when the user walks or runs. This dynamic suspension in the horizontal plane can be therapeutic to the plantar fascia.

With reference to FIG. 70, portions of the perimeter of the footwear can have upward raised edges 321 that extend upward from the protective layer 303 and are adhesively connected to outer surfaces of the foot 309. The raised edges 321 may surround the rear foot 309 and may extend forward towards the toes. The raised edges 321 may normally be omitted from the front portion of the footwear adjacent to the toes. The adhesion plane of the raised edges 321 can be on near vertical perimeter surfaces of the foot 309 which is at a nearly perpendicular angle to the plantar surface of the foot 309 which contacts the elastic layer 301. In contrast to relying upon a peel adhesion force between the footwear and the foot 309, the raised edges 321 can also be elastic and configured to provide shear force adhesion to secure the footwear to the foot 309.

Movement of the foot leads to a rolling liftoff force of the border of the foot relative to the plantar surface of the shoe. Failure of an adhesive shoe construct can be due to the separation of the foot surface from the adhesive surface of the shoe. In one principal mode of failure, Peel off can be derived from tensile forces applied at the edge of the adhesive skin boundary causing separation. For a fixed flat plantar surface that is hard, the natural motion of the foot leads to repetitive cyclical tensile loads applied to the boundary of the plantar adhesive surface and leads to failure. Application of raised edges places the adhesive surface at an angle relative to the tensile forces and converts the tensile force on the interface to a shear force. The adhesive layer is strongest in shear and is better able to resist the shear with repetitive loading and provide greater durability of the interface. Motion of the foot also leads to rotation of the foot relative to the upper surface of the shoe in various planes. One example is the inversion and eversion of the foot which creates a rotation moment arm of the foot relative to the shoe. This moment arm of force creates tensile forces. The raised edge also converts the tensile forces to shear and resists failure of the adhesive attachment.

With reference to FIGS. 70, the inventive footwear can provide more resistance to inversion and eversion rolling of the foot 309 because raised edges 321 of the protective layer 303 are adhesively bonded to the vertical side surfaces of the foot 309. In contrast, normal footwear is not adhesively secured to the foot and allows the heel of the foot to rotate in inversion and eversion which can result in instable support during ankle rotation. When a user applies an inversion and eversion motion, the footwear will remain securely attached and rotate with the foot 309. The footwear will continue to provide stability rather than allowing the foot 309 to rotate independently and slide against the footwear. More specifically an inversion or eversion will be resisted because the adhesives on the inner surfaces of the raised edges 321 can pull the footwear vertically so that there is not peel off due to these rotational forces.

In contrast, an adhesive shoe that relies upon adhesives only on an upper horizontal surfaces may not be able to maintain contact with the foot as the foot moves in inversion and eversion. This rolling rotation of the heel, forefoot or any other portion of the foot will cause peel tension and separation from an inner or outer edge of the shoe resulting in peel away failure of the adhesive and separation of the shoe. For these reasons, the adhesives on the raised edges of the inventive footwear provide superior functionality.

The adhesive attachment of the sole to the plantar surface of the foot can fail by a principal mode of peeling off. This can occur typically by peeling from the outer edge which occurs as liftoff occurs on any area of the plantar surface of the foot relative to a horizontal adhesive surface. In contrast, the raised edge 321 adhesive contour redirects the pull off of the sole from an orientation orthogonal to the plantar surface of the foot 309, an orientation that receives repetitive loads in that orientation with gait to a position that is at an angle relative to the plantar surface and at an angle the varies circumferentially relative to the vertical Z axis relative to the user where the ground defines an X-Y axis horizontal plane. The raised edge 321 can be made of material(s) having elastic properties that allow the raised edge 321 to stretch as the foot 309 moves relative to the footwear. The shear force applied to the adhesive on the raised edge 321 during normal movement including walking and running can be well within the elastic deformation range or spring rate range of the raised edge 321 material(s) and well below the plastic deformation range and tensile strength of the raised edge 321 material(s). Thus, the raised edge 321 can function as an elastic spring that stretches to hold the adhesive footwear to the foot during foot movement.

With reference to FIG. 71, the multi-layer footwear including the protective layer 303 and the elastic layer 301 can be worn under a sock 323. Because the raised edge 321 of the multi-layer sole is adhesively attached to the foot 309, the sock 323 can be easily pulled over the thin multi-layer footwear. The sock 323 can include an elastic material that holds the sock 323 close against the foot 309 which can help prevent movement or removal of the multi-layer sole from the foot 309. In this configuration, the foot 309 with the multi-layer footwear and sock 323 can be placed within any type of footwear. This configuration may be particularly useful for footwear that does not include arch supports such as flip-flops, slippers, clogs and other similar footwear.

The present invention utilizes adhesive regions to attach the footwear to the foot. Various adhesives can be used with the inventive footwear. In an embodiment, a "gecko" adherence technology can be used which does not require the use of traditional tack adhesives. The adherent zone can comprise microstructures that have extensive surface area due to the size and number of microscopic hair like structures. The surface area generates Van der Waal forces sufficient for two surfaces to adhere to each other.

There are numerous advantages to Van der Waal adherent technology. If a "tack adhesive" is not used, there is no residue, which can be left on either of the bonding surfaces. The bonding performance is maintained indefinitely. In contrast, the bonding performance of tack adhesives can degrade readily or only be appropriate for limited on-off cycles. Tack adhesives can also require the use of chemicals and require a separate layer of material for holding the tack adhesive.

However, many tack adhesives are specifically designed for bonding to human skin. In particular, many adhesives are specifically designed for medical applications and are specifically formulated to avoid skin irritation and allergic reactions. An example of a suitable tack adhesive that can be used in the adhesive regions of the inventive footwear is 3M Medical Specialties Product Number 1504XL, Hi Tack Medical Transfer Adhesive on Extended Liner. This adhesive is a synthetic rubber and resin system that can be applied to opposite sides of a thin plastic film and cut into the required shapes of the adhesive regions. The bonding properties of this adhesive can be measured by attaching the adhesive to stainless steel and measuring the force required to remove the adhesive with a 90 degree peel. The nominal force required to remove the adhesive is 5.7 kg/25.4 mm width of adhesive.

In another embodiment, 3M Medical Specialties Product Number 1577, Two-in-One Polyester Double Coated Tape can be used for the adhesive regions. If adhesives are being used on the elastic layer, the tape can use two types of adhesives coated on opposite sides of a polyester carrier film. A synthetic rubber adhesive can be used to secure the adhesive region to the upper surface of the protective layer and the inner surfaces of the raised edges or tabs. An acrylic adhesive can be used to secure the adhesive region to the skin of the users' feet. In this embodiment, the two adhesives can have different bonding properties. For example, the synthetic rubber adhesive can provide a nominal force of 2.8 kg/25.4 mm width of adhesive and the acrylic adhesive can provide a nominal force of 1.5 kg/25.4 mm width of adhesive. This configuration can cause the synthetic rubber adhesive regions to be more aggressively bond the elastic layer to the protective layer and less aggressively bond the protective layer (and possibly portions of the elastic layer) to the foot. If the double coated adhesive tape is used on the upper surface of the elastic layer, the adhesive on the lower surface of the tape can create a stronger bond than the upper surface so that the adhesive tape will remain attached in place on the footwear and release from the foot when the foot is removed from the footwear. The synthetic rubber adhesive may also be thinner than the acrylic adhesive. Because the upper surface of the protective layer can be smooth, the contact area between the protective layer and the synthetic rubber adhesive can be very high since the adhesive does not need to conform to an uneven topography. In contrast, the acrylic adhesive may need to elastically conform to the skin surface which can be an uneven surface. A thicker layer of acrylic adhesive can allow a better interface between the skin and the adhesive. In other embodiments, any other suitable materials can be used for the adhesive regions.

Figure 72:
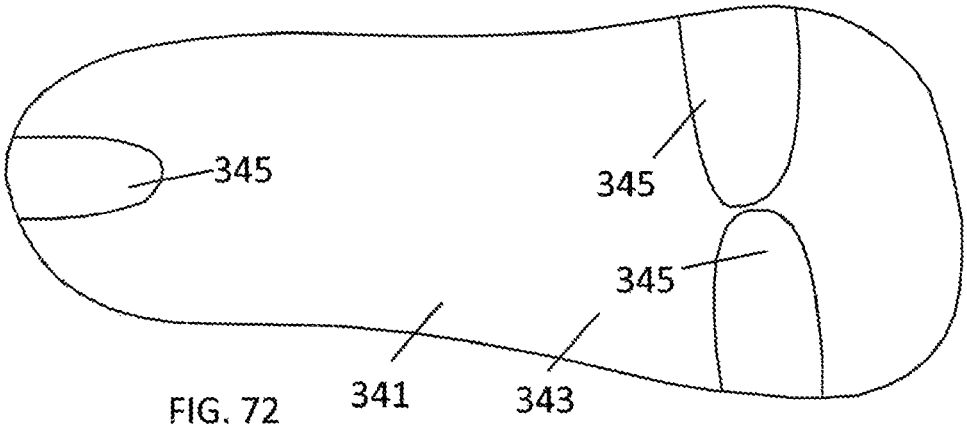
FIG. 72 illustrates a top view of a reusable sole with adhesive strips.
Figure 73:
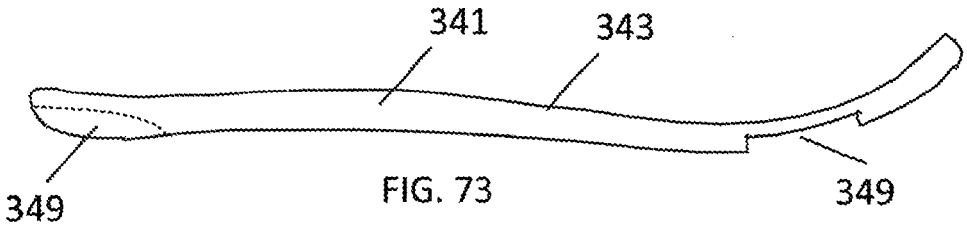
FIG. 73 illustrates a side view of a reusable sole.
Figure 74:
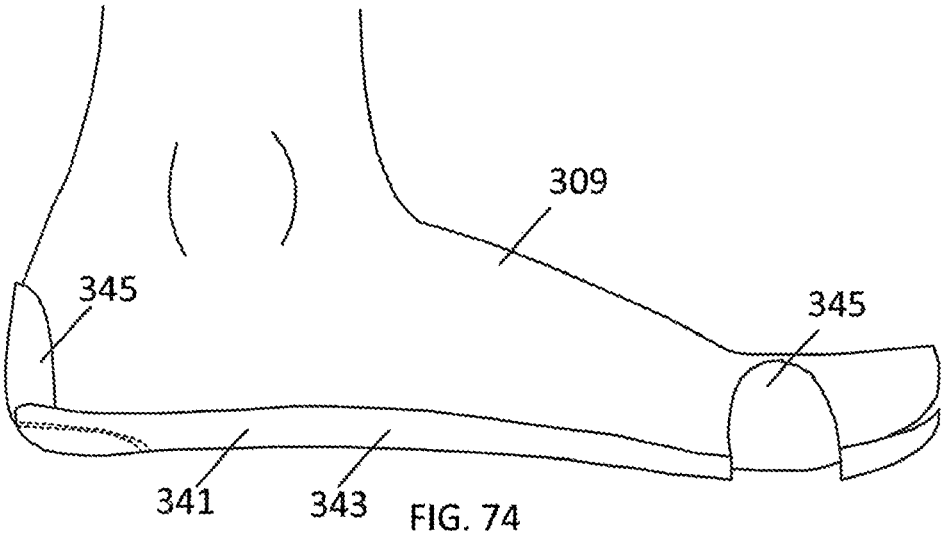
FIG. 74 illustrates a side view of a reusable sole attached to a foot with adhesive strips.

With reference to FIGS. 72-74, an embodiment of an adhesive footwear 341 is illustrated that includes a reusable sole 343 made of an elastic material that is secured to a foot 309 with replaceable elastic adhesive strips 345 which can be located at the forefoot and the heel areas of the foot 309. With reference to FIG. 72, a top view of an embodiment of the footwear 341 is illustrated showing an adhesive strip 345 at the heel and adhesive strips 345 on opposite sides of the forefoot. With reference to FIG. 73, a side view of the footwear 341 is illustrated. The forefoot section can include an elastically bent feature so that the toe section of the sole 343 is raised. This feature can allow the sole 343 to follow the movement of the toes during planter flexion. The sole 343 can also include recessed surfaces 349 which can be used to secure the adhesive strips 345. The recessed surfaces 349 can be raised so that the adhesive strips 345 are not pressed against the ground during walking. With reference to FIG. 74 the adhesive footwear 341 is shown attached to the foot 309. The users can secure the adhesive strips 345 to the foot 309 to hold the reusable soles 343 to the feet 309. The user can then use the adhesive footwear 341 to protect and support the feet 309. The user can remove the adhesive strips 345 to remove the footwear 342 and the adhesives 345 can be replaced prior to the next use of the footwear 342.

Figure 75:
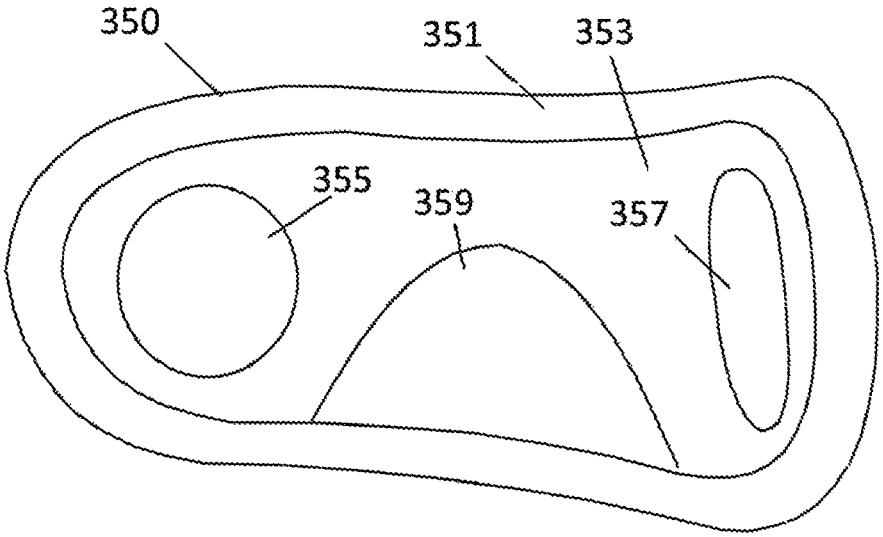
FIG. 75 illustrates a top view of an embodiment of the adhesive footwear.

With reference to FIG. 75, a top view of another embodiment of the footwear 350 is illustrated. The footwear 350 can be made of a single protective layer of elastic material that can have a uniform or a non-uniform thickness. In an embodiment, the footwear 350 can be made of a homogeneous foam or other compressible and flexible material. An adhesive can be applied to only some areas of the upper surface of the footwear 350. More specifically, the footwear 350 can have a center area 353 that does not have an adhesive surface and a perimeter area 351 that does have an adhesive surface. The perimeter area 351 can be bent upward and secured to the perimeter of the foot. The perimeter area 351 can be thinner and more flexible than the center area 353, which can provide cushioning and physical protection to the foot. The center area 353 may also not be uniform in thickness. For example, the footwear 350 can have an integrated arch support 359 which can be thicker than the rest of the center area 353. The main impact areas of the footwear 350 can be the heel area 355 and the metatarsophalangeal (MTP) joint area 357. These areas may also have a different thickness or material density than the other areas of the footwear 350.

Figure 76:
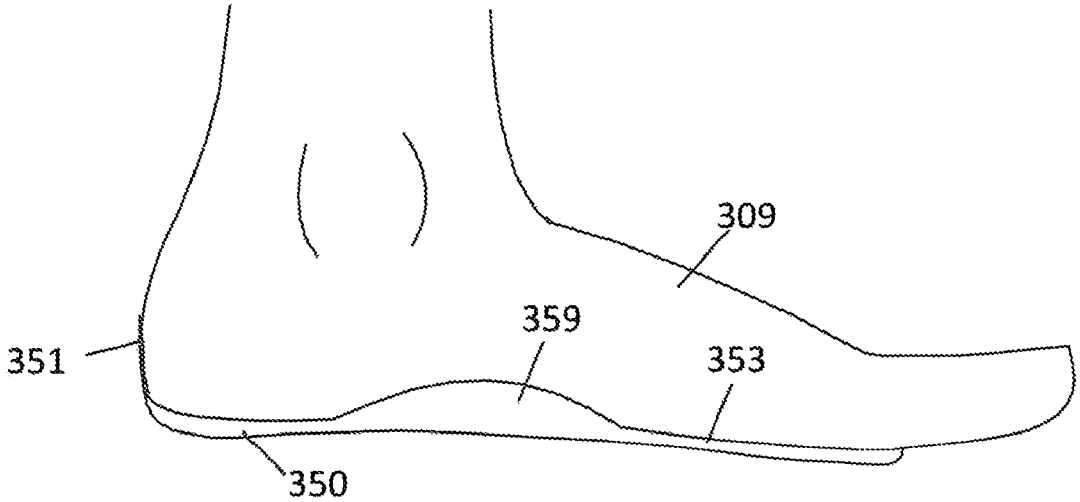
FIG. 76 illustrates a side view of a foot in an embodiment of the adhesive footwear.

With reference to FIG. 76, a side view of a foot 309 attached to the footwear 350 is illustrated. The footwear 350 can extend from the heel to the metatarsophalangeal (MTP) joint area. The perimeter area 351 is shown at the heel portion but not the side of the foot 309 to illustrate the variations in the thickness of the footwear 350. As discussed, the footwear 350 can be thicker in the center area 353 and at the integrated arch support 359. As also discussed, the adhesive may only be applied to specific upper surface areas of the footwear 350 including the perimeter area 351. The adhesive is not applied to the arch support 359.

Figure 77:
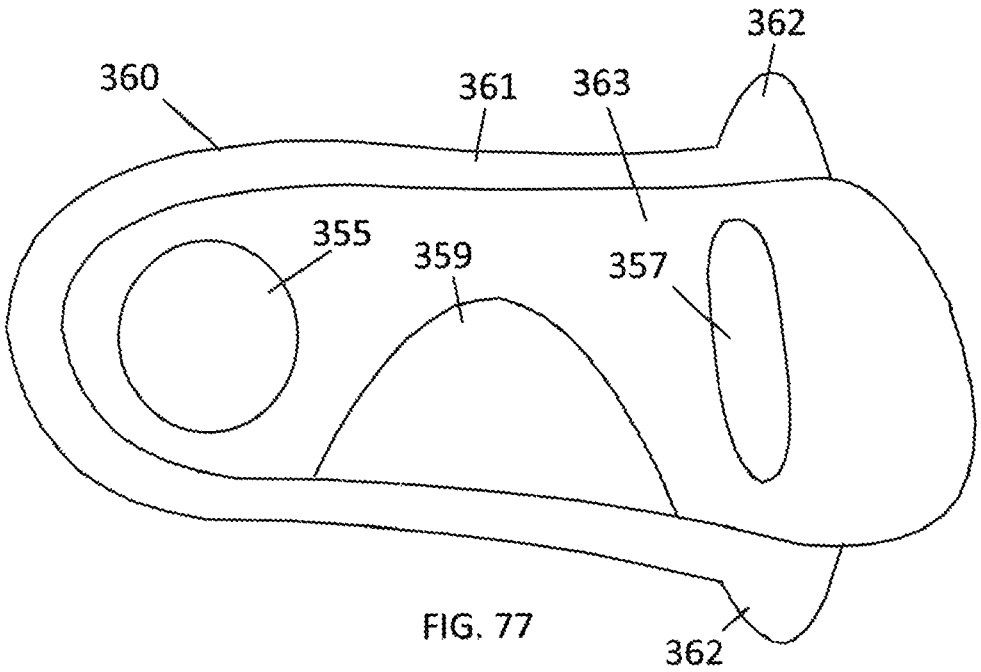
FIG. 77 illustrates a top view of an embodiment of the adhesive footwear.
Figure 78:
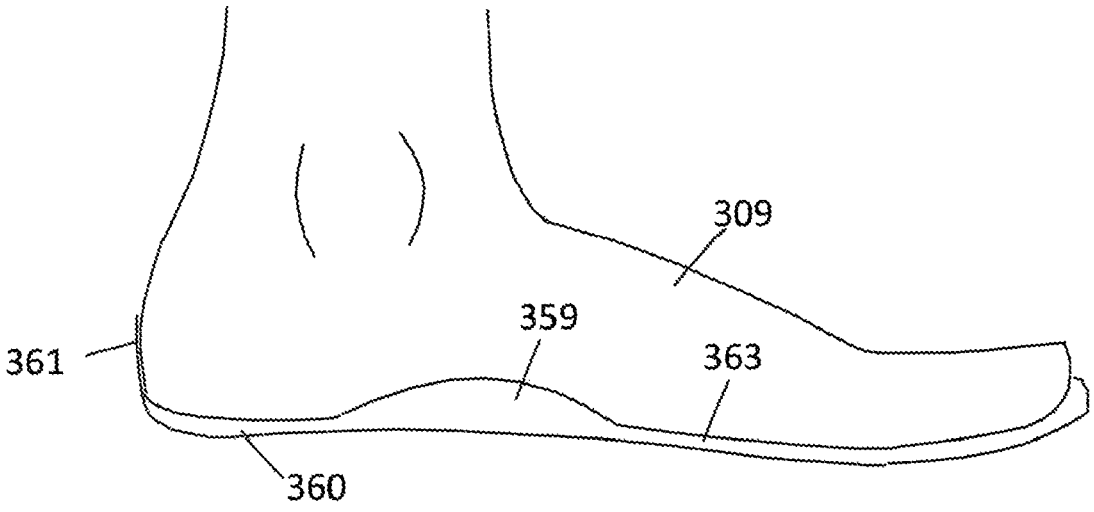
FIG. 78 illustrates a side view of a foot in an embodiment of the adhesive footwear.

With reference to FIGS. 77 and 78, in other embodiments, the footwear 360 may extend forward to protect the toes of the foot. FIG. 77 illustrates a top view of an embodiment of the footwear 360. The footwear 360 can be made of a single protective layer of elastic material that can have a uniform or a non-uniform thickness and can be made of a homogeneous foam or other compressible and flexible material. An adhesive can be applied to a perimeter area 361 but not have a center area 363 that that includes the areas under the toes or the arch area 359. In some embodiments, the perimeter area 361 can have tabs 362 which provide additional adhesive areas. FIG. 78 illustrates a side view of a foot 309 attached to the footwear 360. The footwear 360 can extend from the heel to the toes. The perimeter area 361 is shown at the heel portion but not the side of the foot 309 to illustrate the variations in the thickness of the footwear 360.

Figure 79:
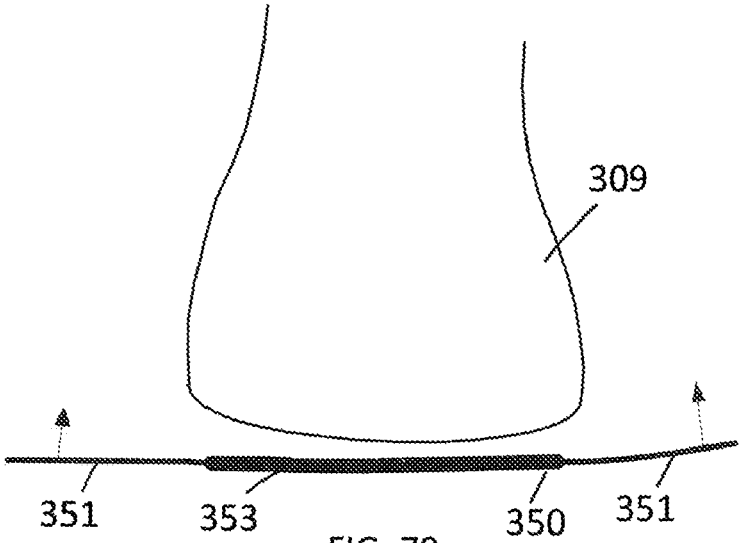
FIGS. 79 and 80 illustrate rear views of a foot in an embodiment of the adhesive footwear.
Figure 80:
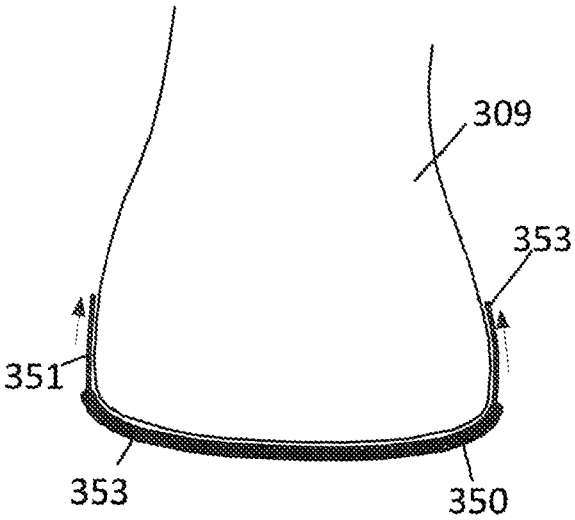

With reference to FIGS. 79 and 80 a rear view of the foot 309 and footwear 350 are illustrated. In FIG. 79, the foot 309 is placed over the thicker center area 353 of the footwear 350 that does not have adhesive material. The thinner perimeters areas 351 of the footwear 350 that have adhesive material can be pulled up but have not been attached to the sides of the foot 309. With reference to FIG. 80, the thinner perimeter areas 351 are pulled in tension and the adhesives on the perimeter areas 351 are attached to the sides of the foot 309. The thicker center area 363 conforms to the bottom surface of the foot 309. The perimeter areas 351 function as elastic adhesive springs which hold the center area 353 to the foot 309.

The protective layers described above, can be many of various rigid or elastic materials. The bottom surface of the protective layer preferably has a non-skid tread which provides traction on the surfaces that the footwear is being used. The protective layer should be able to protect the foot from sharp objects and may also provide some cushioning for the foot to reduce the impact while performing activities such as running on pavements. As discussed, the thickness of the protective layer can be variable with a thicker section at the heel and a thinner more flexible construction at the forefoot portion. The protective layer can be made of multiple materials. For example, the bottom surface can be a strong wear resistant rubber material layer that provides the tread for the footwear. A layer of foam or other elastic material can be attached over the rubber material to provide cushioning for the foot. The upper surface of the protective layer can be made of a smooth material that is comfortable against the plantar surface of the foot.

The upper surface of the protective layer may have a shape that conforms to the contours of the planar surface of the user's foot. The topography of the upper surface of the protective layer may be a custom product based upon actual surface measurements of the user's foot or may correspond to a generic shape based upon the size of the user's foot. The lower surface can have a flatter profile across the width to provide better stability and a larger contact area for improved traction.

Although footwear has been described, the present invention can also be used for other functionality. For swimming, webbing extensions using the described adhesive regions increase the forces that can be applied to the feet for swimming apparatus such as adherent flippers for swimming, scuba, and snorkeling. Adherent flippers can include adherent sections applied to the dorsum of the foot or forefoot to avoid separation from the foot during the upstroke portion of the swimming motion. The inventive adhesive regions can eliminate the need for a heel strap on the flippers and allows for a more conforming forefoot design.

The inventive adhesive regions on a protective layer of footwear can also be applied to other types of shoes. In an embodiment, the footwear can include abrasion resistant coverings for protecting the toes which can be part of specialty shoes used for activities such as ballet and rock climbing. In other embodiments, the protective layer of the inventive footwear can be very stiff in order to transmit more leg energy for activities such as skiing, crew, and cycling. This special footwear can be equipped with specific types of cleats which can be locked into corresponding sport specific binding mechanisms. For some footwear spikes or other protruding mechanisms can be attached to the bottom of the protective layer.

The present invention is substantially different the various known prior art references. U.S. Pat. No. 2,985,970, "Shoes and Means of Attaching Them", E. F. McCarthy discloses a hard shoe with a thick sole. The shoe disclosed by McCarthy includes a hard shoe with adhesive material over the arch of the foot. The shoe has segmental with heel and in ball and toe region but not in lateral border of the metatarsophalangeal (MTP) joint first and fifth and the lateral border of the foot. The shoe disclosed by McCarthy does not function as described.

In contrast to McCarthy, the present invention is directed towards a shoe device that is fully functional and the result of extensive experimentation. Based upon experimental testing, the segmentation of the adhesive footwear components was developed and proven. Specifically, rather than footwear that simply has an adhesive attachment to the foot, the present invention is directed towards only attaching the footwear to the foot with adhesives located at specific locations. In most embodiments, the present invention specifically avoids applying adhesives on the arch and toes of the foot. In an embodiment, it can be possible to attach the arch support to the foot with an adhesive if a hydrogel and the elasticity of the arch support substrate matches the shear properties of the arch. However, without this configuration, the adhesive attachment of the arch support to the arch portion of the foot will be uncomfortable. The prior art does not anticipate that adhesive should not be applied on the arch or toes of the foot. These negative limitations were discovered by empiric trial and skin reaction to shear and discomfort. Similarly, the empty toe embodiments of the present invention are based on empiric data from the discomfort of the application of adhesive to the plantar surface of the toes. The known prior art also does not disclose or suggest adhesive footwear having raised edges or a recessed toe plate to clear in the swing phase of gait to provide apparatus functionality, not for cosmetic reasons. The raised adhesive edge provides stability in fixed locations and can be critical for proper functionality.

It will be understood that the inventive system has been described with reference to particular embodiments, however additions, deletions and changes could be made to these embodiments without departing from the scope of the inventive system. Although the order filling apparatus and method have been described include various components, it is well understood that these components and the described configuration can be modified and rearranged in various other combinations and configurations.

What is claimed is:

1. A footwear apparatus comprising:

an elastic layer having a lower surface and an upper surface;

an adhesive material attached to the upper surface of the elastic layer at a front adhesive region towards a toe end of the footwear apparatus and a rear adhesive region towards a heel end of the footwear apparatus;

a middle non-adhesive region of the upper surface of the elastic layer between the front adhesive region and the rear adhesive region;

an elastic arch support having a non-uniform thickness, the elastic arch support is attached to an adhesive side of the elastic arch support adhesive strip wherein the elastic arch support is in physical contact with the middle non-adhesive region of the upper surface of the elastic layer and not secured to the elastic layer; and a non-adhesive side of the elastic arch support adhesive strip wherein the non-adhesive side is placed against the non-adhesive region on the upper surface of the elastic layer and the adhesive side is adapted to be attached to an arch of a foot.

2. The apparatus of claim 1 further comprising:

a protective layer attached to the lower surface of the elastic layer; and a perimeter extending upward for side edges of the protective layer wherein an adhesive material is attached an inner surface of the perimeter.

3. The apparatus of claim 1 further comprising:

a protective layer attached to the lower surface of the elastic layer; and an asymmetric dorsiflexion mechanism on a front region of the protective layer wherein the front region of the protective layer is more flexible than the rear region of the protective layer.

4. The apparatus of claim 1 further comprising:

a protective layer attached to the lower surface of the elastic layer; and a heel tab coupled to a rear edge of the protective layer wherein the heel tab has a curvature and an adhesive on the inner surface of the heel tab.

5. The apparatus of claim 1 wherein the front adhesive region and the rear adhesive region of the upper surface of the elastic layer are adapted to be adhesively attached to a foot to create a dynamic suspension in a horizontal plane and the elastic layer applies a tension force to the foot when the elastic layer is flat position and the elastic layer applies a compression force to the foot when the elastic layer is curved position.

6. The apparatus of claim 1 further comprising:

recessed areas in the upper surface of the elastic layer wherein the adhesive material is placed in the recessed areas.

7. The apparatus of claim 1 further comprising:

a forefoot adhesive strip that extends through a hole or a slot that extends through a width of the elastic layer.

8. The apparatus of claim 1 wherein the elastic layer is adapted to be adhesively secured to a bottom surface of a foot between a heel area and a metatarsophalangeal joint area of a foot and the elastic layer is adapted to not extend forward of the metatarsophalangeal joint area.

9. A footwear apparatus comprising:

a protective layer having a lower surface and an upper surface;

an elastic layer attached to the upper surface of the protective layer wherein the elastic layer is more elastic than the protective layer and the protective layer is harder than the elastic layer;

an adhesive material attached to a front adhesive region towards a toe end of the footwear apparatus and a rear adhesive region on an upper surface of the elastic layer;

a non-adhesive region on the upper surface of the elastic layer between the front adhesive region and the rear adhesive region towards a heel end of the footwear apparatus;

an elastic arch support having a non-uniform thickness, the elastic arch support is attached to an adhesive side of an elastic arch support adhesive strip wherein the elastic arch support is in physical contact with the middle non-adhesive region of the upper surface of the elastic layer and not secured to the elastic layer; and a non-adhesive side of the elastic arch support adhesive strip wherein the non-adhesive side is placed against the non-adhesive region on the upper surface of the elastic layer and the adhesive side is adapted to be attached to an arch of a foot.

10. The apparatus of claim 9 further comprising:

a perimeter extending upward for side edges of the protective layer wherein an adhesive material is attached an inner surface of the perimeter.

11. The apparatus of claim 9 further comprising:

an asymmetric dorsiflexion mechanism on a front region of the protective layer wherein the front region of the protective layer is more flexible than the rear region of the protective layer.

12. The apparatus of claim 9 further comprising:

a heel tab coupled to a rear edge of the protective layer wherein the heel tab has a curvature and an adhesive on the inner surface of the heel tab.

13. The apparatus of claim 9 wherein the front adhesive region and the rear adhesive region of the upper surface of the elastic layer are adapted to be adhesively attached to a foot to create a dynamic suspension in a horizontal plane and the protective layer applies a tension force to the foot when the protective layer is flat position and the protective layer applies a compression force to the foot when the protective layer is curved position.

14. The apparatus of claim 9 further comprising:

recessed areas in the upper surface of the elastic layer wherein the adhesive material is placed in the recessed areas.

15. The apparatus of claim 9 further comprising:

a forefoot adhesive strip that extends through a hole or a slot that extends through a width of the protective layer.

16. The apparatus of claim 9 wherein the protective layer is adapted to be adhesively secured to a bottom surface of a foot between a heel area and a metatarsophalangeal joint area of a foot and the protective layer is adapted to not extend forward of the metatarsophalangeal joint area.

* * * * *